US011699382B2

(12) United States Patent
Feng et al.

(10) Patent No.: US 11,699,382 B2
(45) Date of Patent: Jul. 11, 2023

(54) DISPLAY DEVICE, METHOD FOR DRIVING A DISPLAY DEVICE, AND DISPLAY DRIVING CIRCUIT

(71) Applicants: Hefei BOE Joint Technology Co., Ltd., Anhui (CN); BOE TECHNOLOGY GROUP CO., LTD., Beijing (CN)

(72) Inventors: Xuehuan Feng, Beijing (CN); Xing Yao, Beijing (CN); Jingbo Xu, Beijing (CN); Xuelian Cheng, Beijing (CN)

(73) Assignees: Hefei BOE Joint Technology Co., Ltd., Anhui (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 17/780,626

(22) PCT Filed: Jul. 21, 2021

(86) PCT No.: PCT/CN2021/107587
§ 371 (c)(1),
(2) Date: May 27, 2022

(87) PCT Pub. No.: WO2023/000203
PCT Pub. Date: Jan. 26, 2023

(65) Prior Publication Data
US 2023/0025310 A1 Jan. 26, 2023

(51) Int. Cl.
*G09G 3/3266* (2016.01)
*G09G 3/20* (2006.01)

(52) U.S. Cl.
CPC ..... *G09G 3/2074* (2013.01); *G09G 3/3266* (2013.01); *G09G 2300/0443* (2013.01); (Continued)

(58) Field of Classification Search
CPC ..... G09G 3/2022; G09G 3/2074; G09G 3/32; G09G 3/3233; G09G 3/3266; (Continued)

(56) References Cited

U.S. PATENT DOCUMENTS

2008/0012791 A1* 1/2008 Ku ..... G09G 3/3648 345/3.2
2009/0243995 A1* 10/2009 Kimura ..... G09G 3/342 345/102
2022/0208106 A1* 6/2022 Kim ..... G09G 3/3266

* cited by examiner

*Primary Examiner* — Michael J Eurice
(74) *Attorney, Agent, or Firm* — Houtteman Law LLC

(57) ABSTRACT

Provided is a method for driving a display device including n rows of sub-pixels; the method includes: driving the first frame of image, including: performing normal display driving on the n rows of sub-pixels in a display driving period, performing darkness insertion driving on a rows, from the $1^{st}$ to $a^{th}$ rows, of sub-pixels in a first darkness insertion sub-period, and performing darkness insertion driving on (n−a) rows, from the $(a+1)^{th}$ to $n^{th}$ rows, of sub-pixels in a second darkness insertion sub-period driving a second frame of image, including: performing normal display driving on the n rows of sub-pixels in a display driving period, performing darkness insertion driving on b rows, from the $1^{st}$ to $b^{th}$ rows, of sub-pixels in a first darkness insertion sub-period, and performing darkness insertion driving on (n−b) rows, from the $(b+1)^{th}$ to $n^{th}$ rows, of sub-pixels in a second darkness insertion sub-period.

20 Claims, 13 Drawing Sheets

(52) U.S. Cl.
CPC ..... *G09G 2310/061* (2013.01); *G09G 2310/08* (2013.01); *G09G 2320/0257* (2013.01)

(58) Field of Classification Search
CPC ..... G09G 3/3291; G09G 2300/0443; G09G 2300/0819; G09G 2300/0842; G09G 2310/0205; G09G 2310/04; G09G 2310/061; G09G 2310/062; G09G 2310/08; G09G 2320/0257; G09G 2320/0295; G09G 2320/046; G09G 2340/0435
See application file for complete search history.

DISPLAY DEVICE, METHOD FOR DRIVING A DISPLAY DEVICE, AND DISPLAY DRIVING CIRCUIT

TECHNICAL FIELD

The present disclosure relates to the field of display technology, and in particular, to a display device, a method for driving the display device, and a display driving circuit.

BACKGROUND

In the field of display technology, especially in an Organic Light Emitting Diode (OLED) display device, a dynamic image smear phenomenon is easily occurred during switching of images displayed on a dynamic display screen, that is, when a previous frame of image displayed is switched to a next frame of image displayed, a smear of the previous frame of image may be sensed. In order to overcome the dynamic image smear phenomenon, in the related art, a darkness screen is to be switched to during pixels emitting light, so as to reduce normal display time duration of the pixels, thereby effectively improving the dynamic image smear phenomenon.

SUMMARY

In a first aspect, an embodiment of the present disclosure provides a method for driving a display device, where the display device includes: n rows of sub-pixels, n being a positive integer and n>2;

each frame of image is correspondingly configured with a display period and a darkness insertion driving period, and the display period includes a display driving period and a blank period which are not overlapped with each other, the darkness insertion driving period includes a first darkness insertion sub-period and a second darkness insertion sub-period, for a same frame of image, the first darkness insertion sub-period being after a starting time of the display driving period and before the blank period, the second darkness insertion sub-period being after a starting time of the blank period;

the method includes:

performing driving for a first frame of image, which includes: sequentially performing normal display driving on n rows of sub-pixels in a corresponding display driving period, performing darkness insertion driving on a rows, from $1^{st}$ row to $a^{th}$ row, of sub-pixels in a corresponding first darkness insertion sub-period, and performing darkness insertion driving on (n−a) rows, from the $(a+1)^{th}$ row to the $n^{th}$ row, of sub-pixels in a corresponding second darkness insertion sub-period, where a is a positive integer and a<n;

performing driving for a second frame of image, which includes: performing normal display driving on the n rows of sub-pixels in a corresponding display driving period, performing darkness insertion driving on b rows, from $1^{st}$ row to the $b^{th}$ row, of sub-pixels in a corresponding first darkness insertion sub-period, and performing darkness insertion driving on (n−b) rows, from the $(b+1)^{th}$ row to the $n^{th}$ row, of sub-pixels in a corresponding second darkness insertion sub-period, where b is a positive integer, b<n and b≠a.

In some implementations, the first frame of image and the second frame of image are two frames of images adjacent to each other.

In some implementations, for the display period of a same frame of image, the blank period is after the display driving period.

In some implementations, for a same frame of image, the second darkness insertion sub-period is after an ending time of the blank period.

In some implementations, during the driving for the first frame of image, a time interval between a starting time of the normal display driving of the $1^{st}$ row of sub-pixels and a starting time of the darkness insertion driving of the $1^{st}$ row of sub-pixels is j1, and a time interval between the starting time of the normal display driving of the $1^{st}$ row of sub-pixels and a starting time of the blank period is j2;

during the driving for the second frame of image, a time interval between the starting time of the normal display driving of the $1^{st}$ row of sub-pixels and the starting time of the darkness insertion driving of the $1^{st}$ row of sub-pixels is j3, and a time interval between the starting time of the normal display driving of the $1^{st}$ row of sub-pixels and the starting time of the blank period is j4;

where j1≠j3 and j2=j4.

In some implementations, for the display period of a same frame of image, the display driving period includes: a first portion and a second portion, where part of rows of sub-pixels are subjected to the normal display driving in the first portion, and the other part of rows of sub-pixels are subjected to the normal display driving in the second portion; and the blank period is between the first portion and the second portion.

In some implementations, during the driving for the first frame of image, a time interval between a starting time of the normal display driving of the $1^{st}$ row of sub-pixels and a starting time of the darkness insertion driving of the $1^{st}$ row of sub-pixels is j1, and a time interval between the starting time of the normal display driving of the $1^{st}$ row of sub-pixels and a starting time of the blank period is j2;

during the driving for the second frame of image, a time interval between a starting time of the normal display driving of the $1^{st}$ row of sub-pixels and a starting time of the darkness insertion driving of the $1^{st}$ row of sub-pixels is j3, and a time interval between the starting time of the normal display driving of the $1^{st}$ row of sub-pixels and the starting time of the blank period is j4;

where j1=j3 and j2≠j4.

In some implementations, during the driving for the first frame of image, a time interval between a starting time of the normal display driving of the $1^{st}$ row of sub-pixels and a starting time of the darkness insertion driving of the $1^{st}$ row of sub-pixels is j1, and a time interval between the starting time of the normal display driving of the $1^{st}$ row of sub-pixels and a starting time of the blank period is j2;

during the driving for the second frame of image, a time interval between a starting time of the normal display driving of the $1^{st}$ row of sub-pixels and a starting time of the darkness insertion driving of the $1^{st}$ row of sub-pixels is j3, and a time interval between the starting time of the normal display driving of the $1^{st}$ row of sub-pixels and the starting time of the blank period is j4;

where j1≠j3 and j2≠j4.

In some implementations, the n rows of sub-pixels are divided into s sub-pixel row groups which are sequentially arranged, each sub-pixel row group includes c rows of sub-pixels, both s and c are positive integers and s*c=n; a=c*s1, b=c*s2, s1 is a positive integer and s1<s, s2 is a positive integer and s2<s, and s1≠s2;

during performing darkness insertion driving on the rows of sub-pixels in the first darkness insertion sub-period or the second darkness insertion sub-period, the darkness insertion driving is performed on the sub-pixel row groups one by one, and the darkness insertion driving is performed on the rows of sub-pixels in a same sub-pixel row group simultaneously.

In some implementations, in the first darkness insertion sub-period or the second darkness insertion sub-period, a time interval between starting times at which two adjacent sub-pixel row groups start to be subjected to the darkness insertion driving is H, H=c*h, h being a duration corresponding to the darkness insertion driving performed on each row of sub-pixels.

In some implementations, there is no overlap between a period in which any one of the sub-pixel row groups is subjected to the darkness insertion driving and a period in which any row of sub-pixels is subjected to the normal display driving.

In some implementations, the display driving period includes: s display driving sub-periods which are in correspondence with the sub-pixel row groups one to one, where a time interval exists between any two adjacent display driving sub-periods, the time interval is greater than h, and h being a duration corresponding to the darkness insertion driving performed on each row of sub-pixel;

the period during which any one of the sub-pixel row groups is subjected to the darkness insertion driving is within the time interval between any two adjacent display driving sub-periods or within the blank period.

In some implementations, for the period during which the darkness insertion driving is performed on the s sub-pixel row groups corresponding to a same frame of image, a period during which the darkness insertion driving is performed on one sub-pixel row group is located in the blank period, and each period during which the darkness insertion driving is performed on each of other (s−1) sub-pixel row groups is located in the time interval between two adjacent display driving sub-periods corresponding thereto.

In some implementations, where $2 \leq c \leq 8$.

In some implementations, before the performing driving for each frame of image, the method further includes:

obtaining a display gray scale of each sub-pixel in the frame of image to be driven, and detecting whether there is any sub-pixel with the display gray scale smaller than a first preset gray scale;

if the sub-pixel with the display gray scale smaller than the first preset gray scale is detected, setting a light-emission duty ratio of the frame of image to be driven to be a first preset value Q1;

if no sub-pixel with the display gray scale smaller than the first preset gray scale is detected, setting the light-emission duty ratio of the frame of image to be driven to be a second preset value Q2;

the light-emission duty ratio of the frame of image to be driven is t0/T, t0 represents a time interval between a starting time of the normal display driving of the $1^{st}$ row of sub-pixels and a starting time of the darkness insertion driving of the $1^{st}$ row of sub-pixels in a subsequent driving process of the frame of image to be driven, and T represents a total duration of the display period of the frame of image in the subsequent driving process of the frame of image to be driven; and $0<Q1<1$, $0<Q2<1$, and $Q1<Q2$.

In some implementations, a maximum display gray scale to be displayed by the sub-pixel in the display device is 1023, and the first preset gray scale is 32.

In some implementations, Q1=25% and Q2=50%.

In some implementations, the method further includes: after the sub-pixel with the display gray scale smaller than the first preset gray scale is detected and before the light-emission duty ratio of the frame of image to be driven is set to the first preset value, detecting whether there is any sub-pixel with the display gray scale larger than a second preset gray scale;

if the sub-pixel with the display gray scale larger than the second preset gray scale is detected, setting the light-emission duty ratio of the frame of image to be driven to be the first preset value; and if no sub-pixel with the display gray scale larger than the second preset gray scale is detected, setting the light-emission duty ratio of the frame of image to be driven to be a third preset value Q3, where $Q3<Q1$.

In some implementations, a maximum display gray scale to be displayed by the sub-pixel in the display device is 1023, the first preset gray scale is 32, and the second preset gray scale is 255.

In some implementations, Q1=25%, Q2=50%, and Q3=10%.

In some implementations, after setting the light-emission duty ratio of the frame of image to be driven, the method further includes:

determining a maximum gray scale voltage corresponding to the maximum display gray scale to be displayed by the sub-pixel in the display device in a subsequent driving process of the frame of image to be driven according to the set light-emission duty ratio of the frame of image to be driven; and performing gray scale voltage expansion according to the maximum gray scale voltage to determine gray scale voltages corresponding to different display gray scales.

In a second aspect, an embodiment of the present disclosure further provides a display driving circuit for implementing the method mentioned above, the display driving circuit being applied to a display device, the display device includes: n rows of sub-pixels, n is a positive integer and $n>2$;

each frame of image is correspondingly configured with a display period and a darkness insertion driving period, and the display period includes a display driving period and a blank period which are not overlapped with each other, the darkness insertion driving period includes a first darkness insertion sub-period and a second darkness insertion sub-period, for a same frame of image, the first darkness insertion sub-period being after a starting time of the display driving period and before the blank period, the second darkness insertion sub-period being after a starting time of the blank period, the display driving circuit includes a gate driving circuit;

the gate driving circuit is configured to: in a driving process of a first frame of image, sequentially perform normal display driving on the rows of sub-pixels in the corresponding display driving period, perform darkness insertion driving on rows, from $1^{st}$ row to $a^{th}$ row, of sub-pixels in the first darkness insertion sub-period corresponding thereto, and perform darkness insertion driving on rows, from $(a+1)^{st}$ row to $(n-a)^{th}$ row, of sub-pixel in the second darkness insertion sub-period corresponding thereto, where a is a positive integer and $a<n$; and in a driving process of the second frame of image, sequentially perform normal display driving on the rows of sub-pixels in the corresponding display driving period, perform darkness insertion driving on b rows, from $1^{st}$ row to $b^{th}$ row, of sub-pixels in the first darkness insertion sub-period corresponding thereto, and perform darkness insertion driving on (n−b) rows, from $(b+1)^{th}$ row to $n^{th}$ row, of sub-pixels in the second darkness insertion sub-period corresponding thereto, where b is a positive integer, b<n and b≠a.

In some implementations, the display driving circuit further includes a central control panel;

the central control panel is configured to: before the display driving circuit drives each frame of image, obtain a display gray scale of each of the sub-pixels in the frame of image to be driven, and detect whether there is any sub-pixel with the display gray scale smaller than a first preset gray scale; if the sub-pixel with the display gray scale smaller than the first preset gray scale is detected, set a light-emission duty ratio of the frame of image to be driven to be a first preset value Q1; if no sub-pixel with the display gray scale smaller than the first preset gray scale is detected, set the light-emission duty ratio of the frame of image to be driven to be a second preset value Q2.

In some implementations, the central control panel is further configured to: after the sub-pixel with the display gray scale smaller than the first preset gray scale is detected and before setting the light-emission duty ratio of the frame of image to be driven to be the first preset value, detect whether there is any sub-pixel with the display gray scale larger than a second preset gray scale; if the sub-pixel with the display gray scale larger than a second preset gray scale is detected, set the light-emission duty ratio of the frame of image to be driven to be the first preset value; if no sub-pixel with the display gray scale larger than the second preset gray scale is detected, set the light-emission duty ratio of the frame of image to be driven to be a third preset value Q3.

In a third aspect, an embodiment of the present disclosure further provides a display device, including: the display driving circuit as provided in the second aspect.

DRAWINGS

Figure 7A:
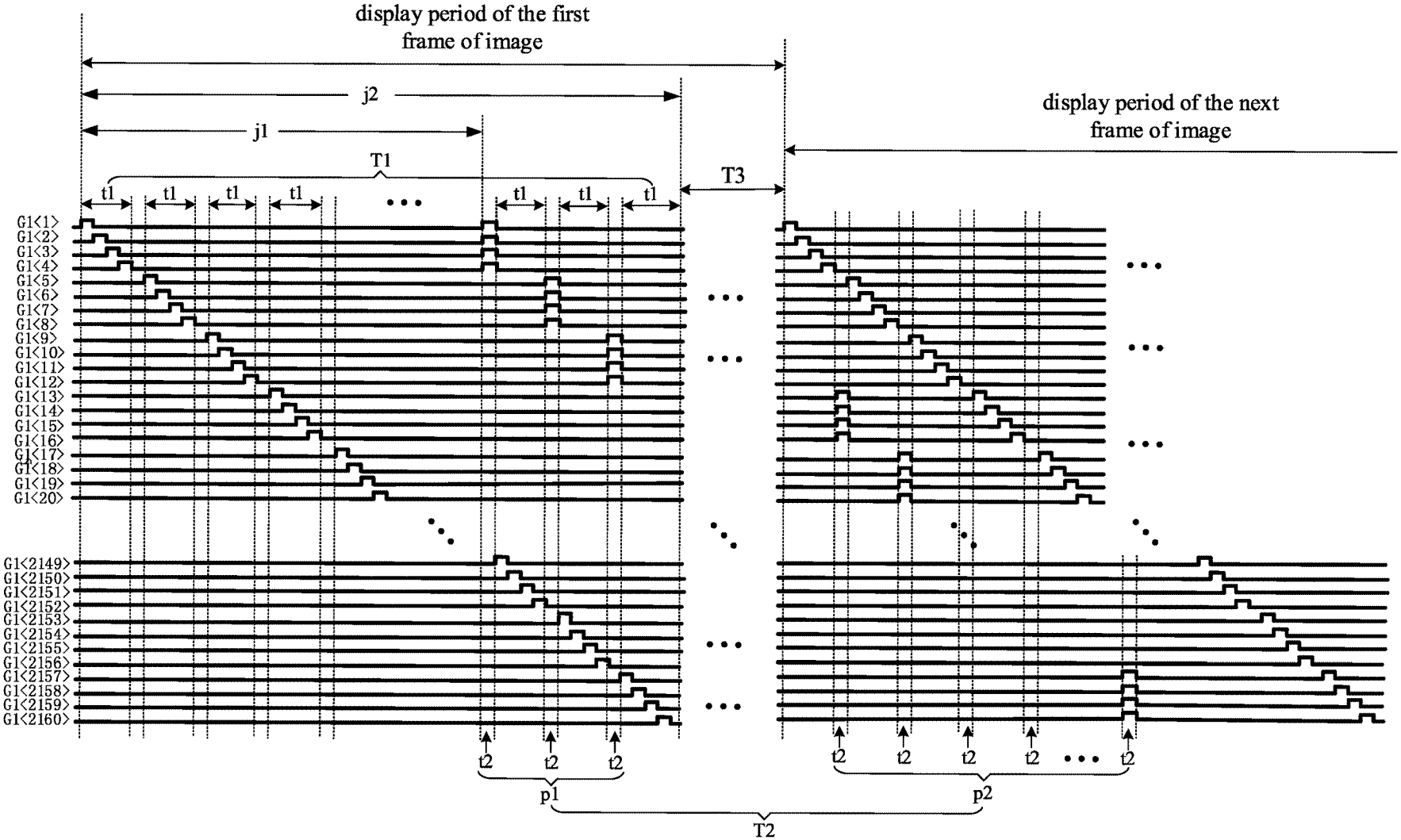
Figure 7B:
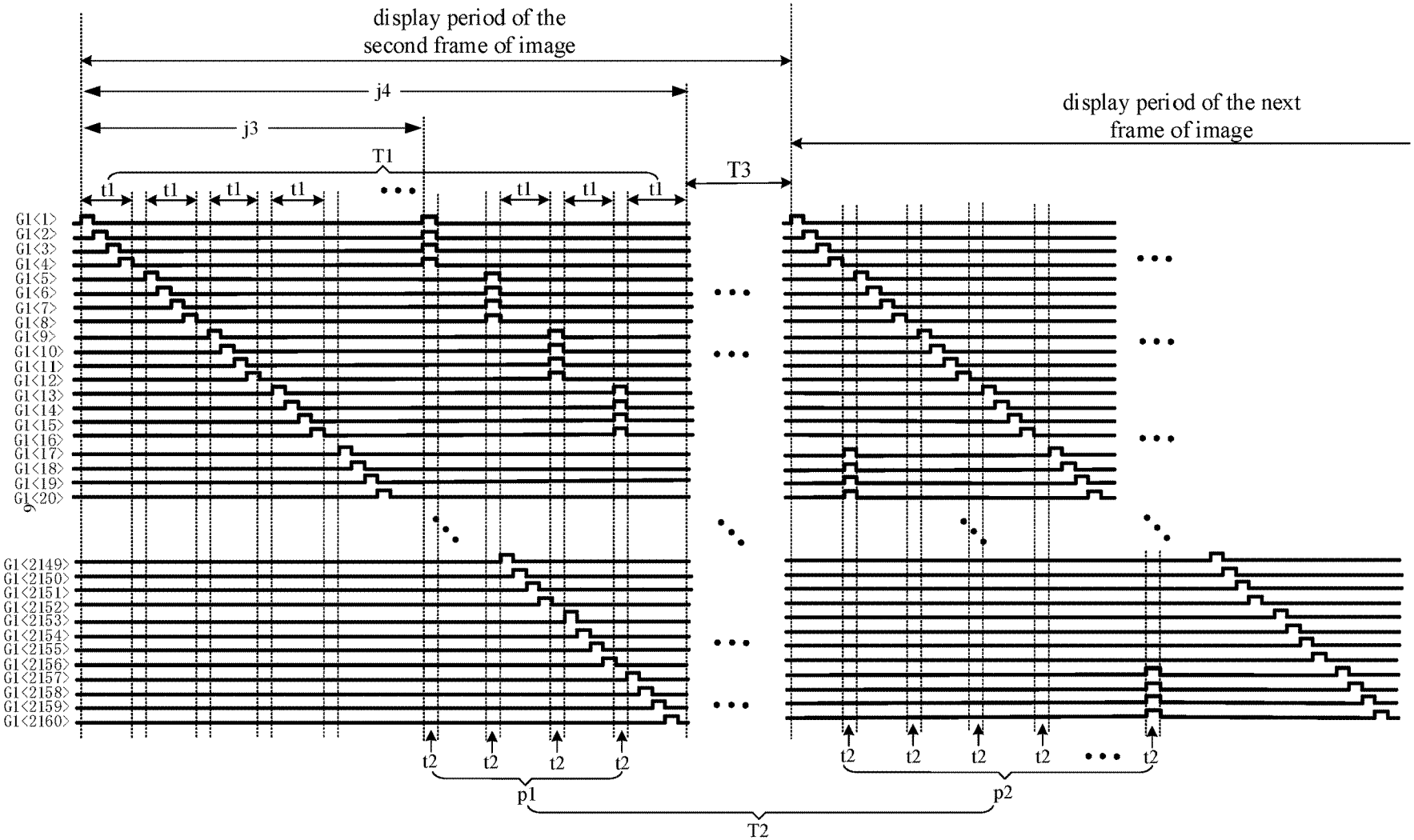
Figure 8A:
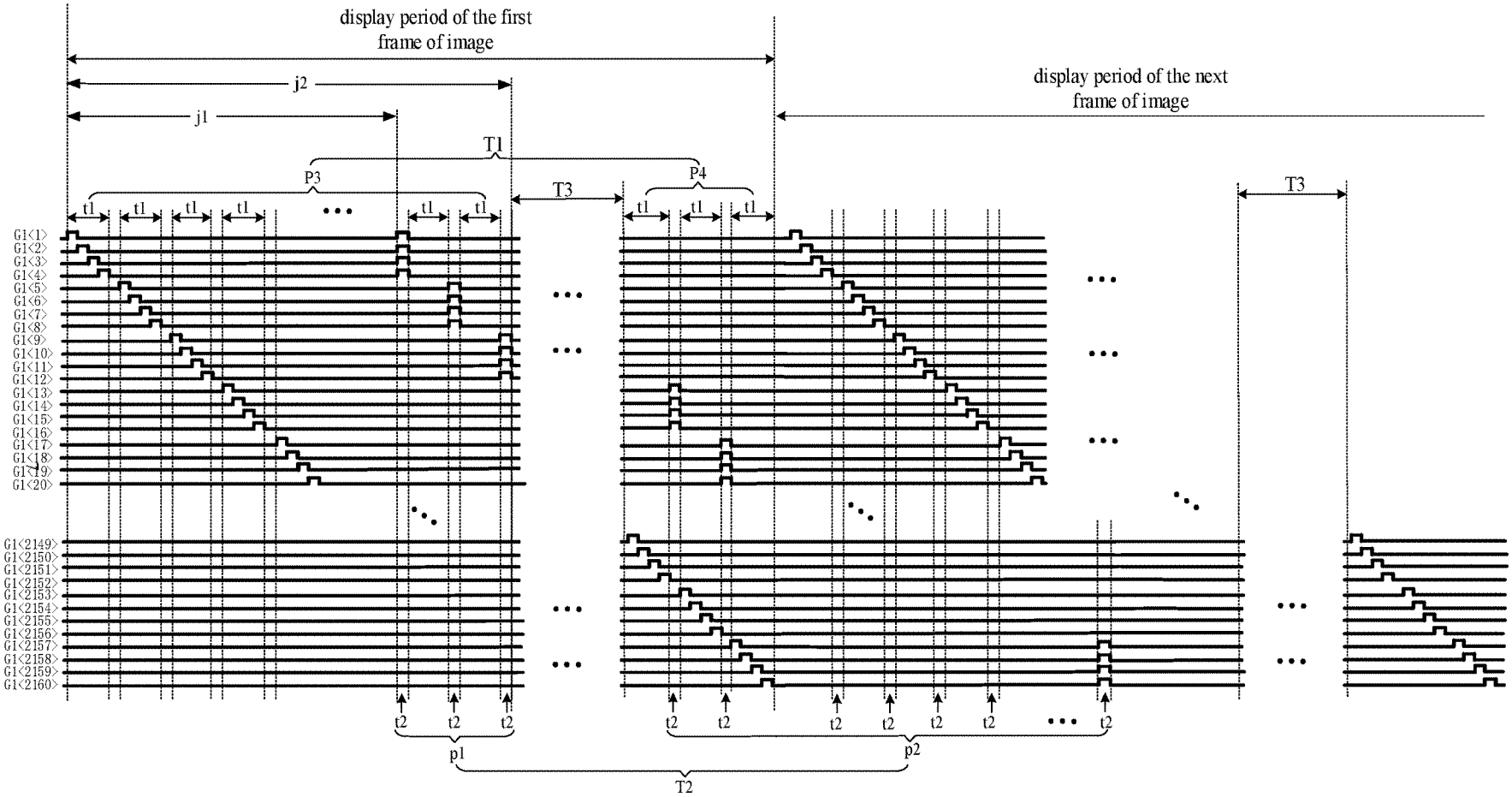
Figure 8B:
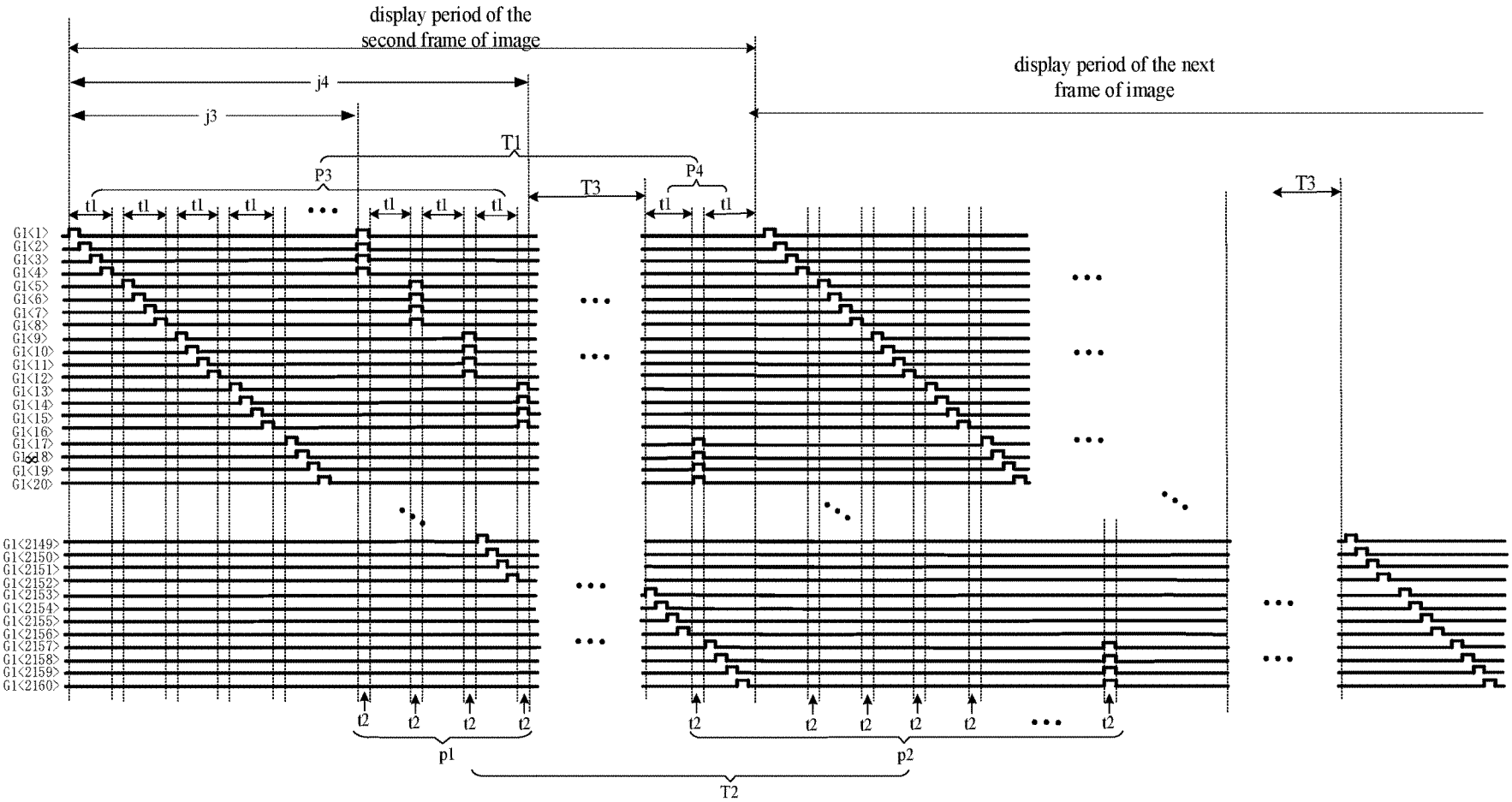
Figure 9:
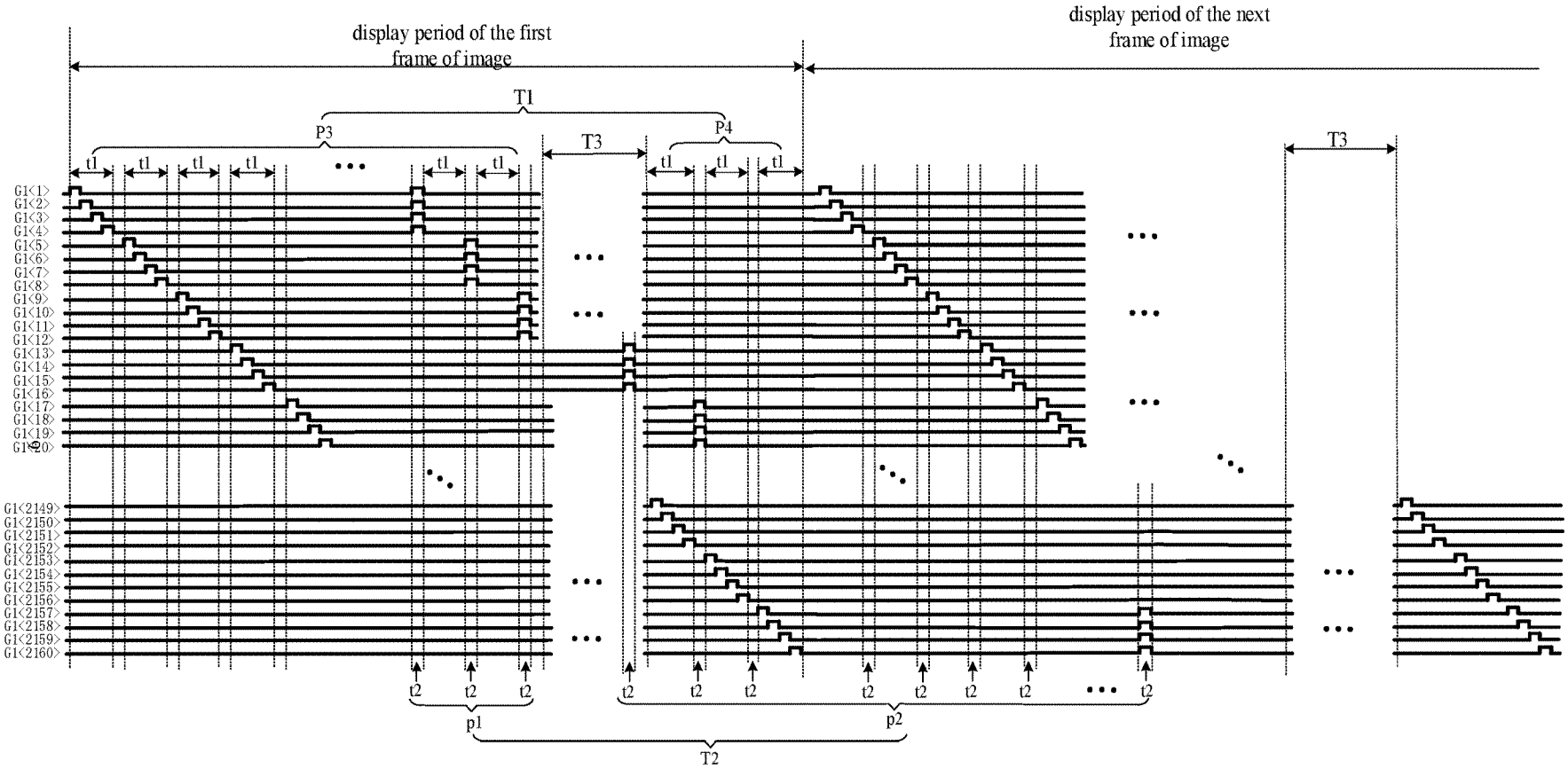
Figure 10:
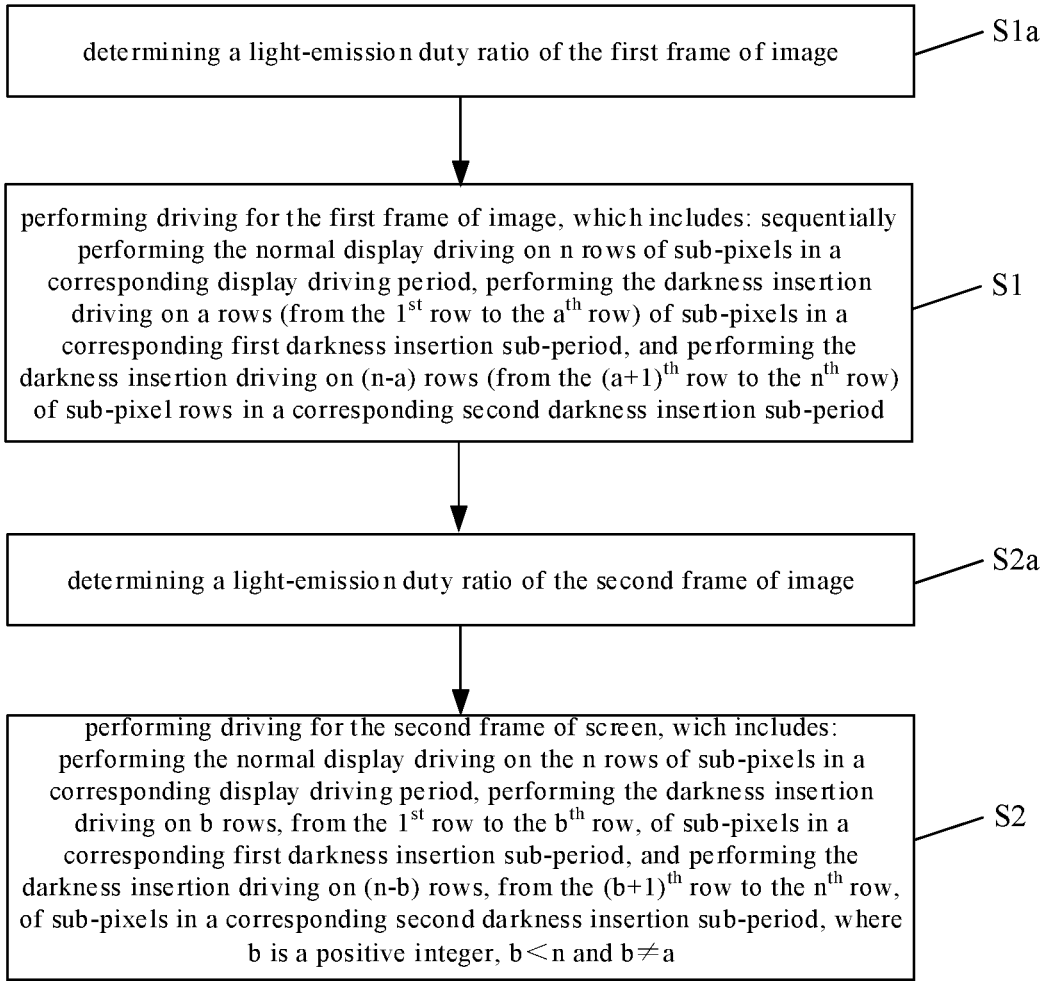
Figure 11:
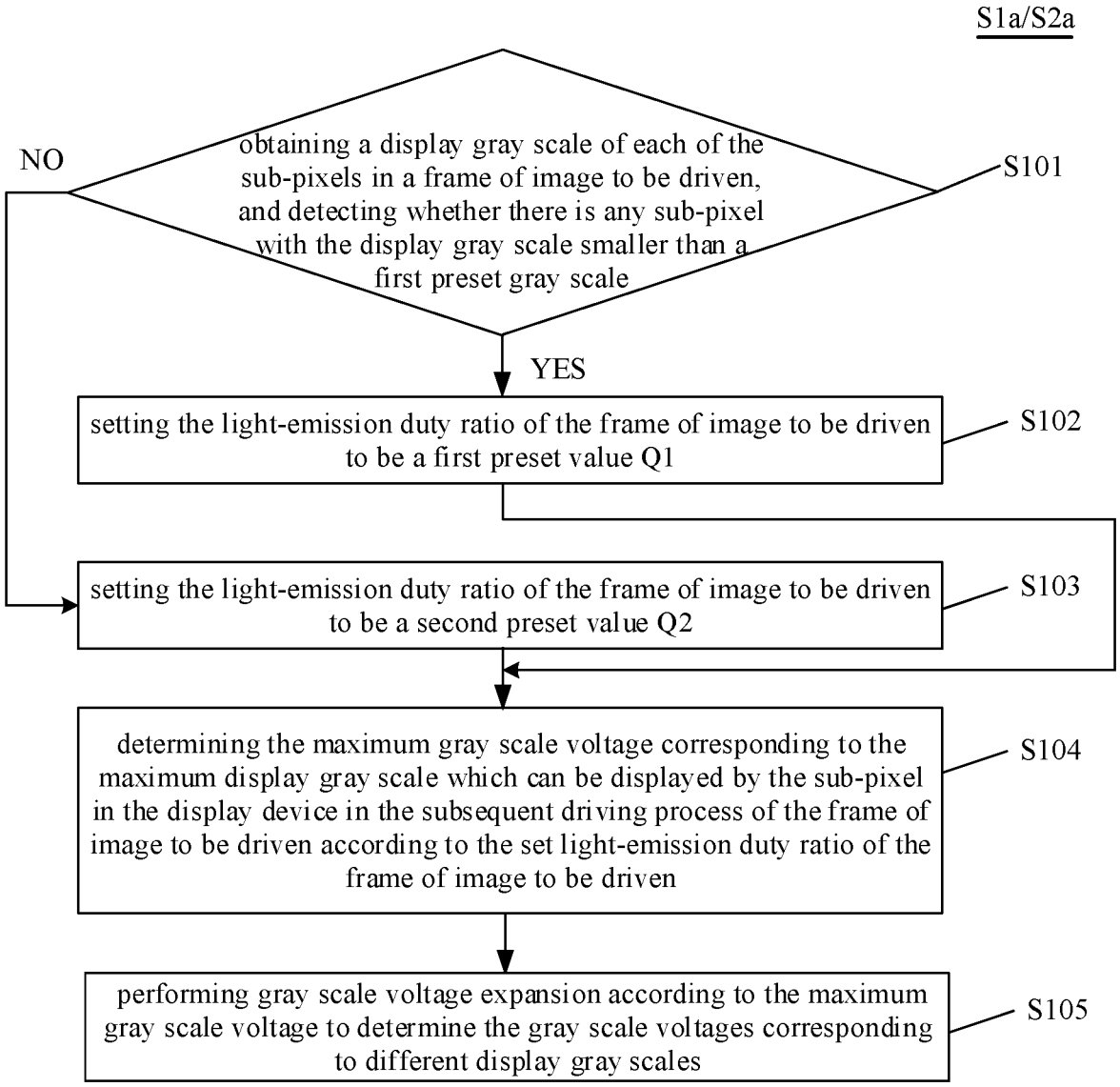
Figure 12:
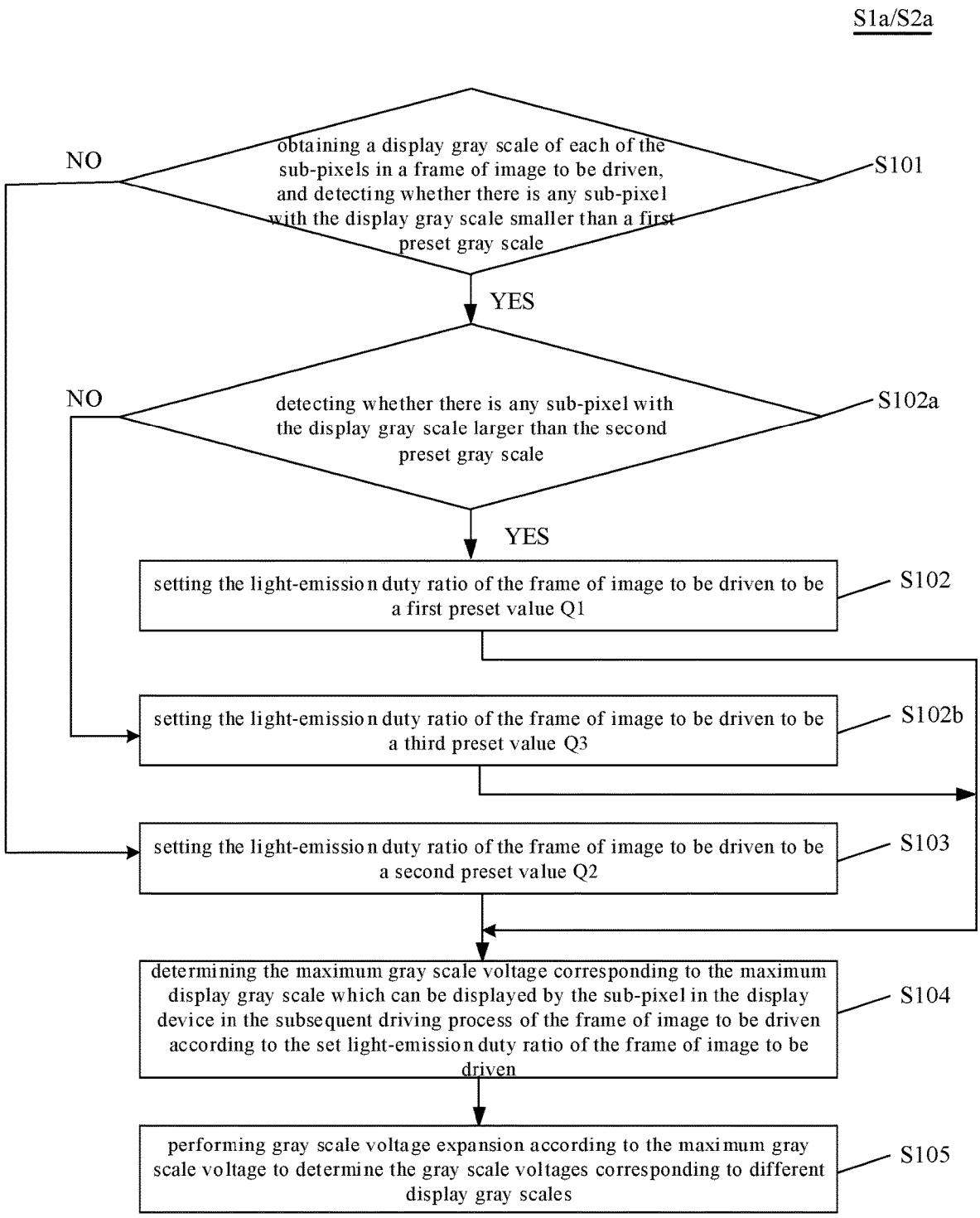

FIG. 7*a* is an operation timing diagram of driving a first frame of image in a step S1 according to an embodiment of the present disclosure;

FIG. 7*b* is an operation timing diagram of driving a second frame of image in a step S2 according to an embodiment of the present disclosure;

FIG. 8*a* is another operation timing diagram of driving a first frame of image in a step S1 according to an embodiment of the present disclosure;

FIG. 8*b* is another operation timing diagram of driving a second frame of image in a step S2 according to an embodiment of the present disclosure;

FIG. 9 is an operation timing diagram of driving a certain frame of image according to an embodiment of the present disclosure;

FIG. 10 is a flowchart of a method for driving a display device according to an embodiment of the present disclosure;

FIG. 11 is a flowchart of an alternative implementation of steps S1*a* and S2*a* of FIG. 10;

FIG. 12 is a flowchart of another alternative implementation of step S1*a* and step S2*a* in FIG. 10.

Figure 13:
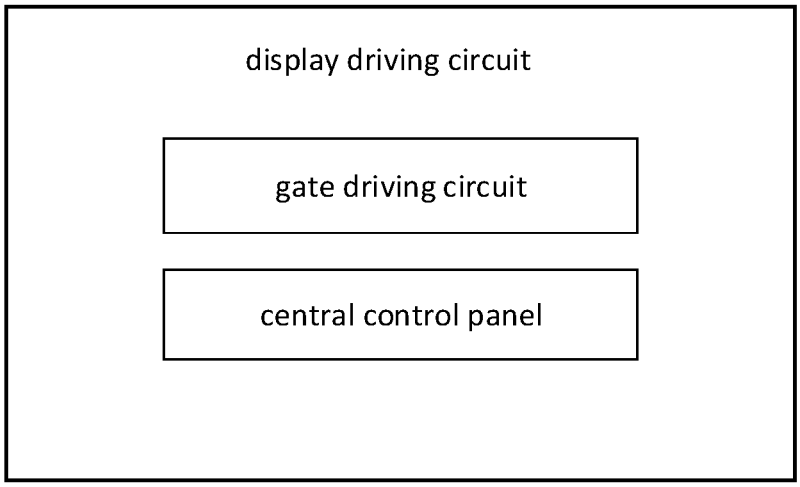

FIG. 13 is a schematic top view of a display driving circuit according to an embodiment of the present disclosure.

DETAILED DESCRIPTION

In order to make those skilled in the art better understand the technical solutions of the present disclosure, a display device, a method for driving the same, and a display driving circuit provided by the present disclosure are described in detail below with reference to the accompanying drawings.

The use of "first," "second," and the like in the present disclosure is not intended to indicate any order, quantity, or importance, but rather is used to distinguish one element from another. The word "include" or "comprise", and the like, means that the element or item preceding the word contains the element or item listed after the word and its equivalent, but does not exclude other elements or items. The terms "connect" or "couple" and the like are not restricted to physical or mechanical connections, but may include electrical connections, whether direct or indirect.

The transistors adopted in the embodiments of the present disclosure may be thin film transistors or field effect transistors or other devices having the same characteristics. In the embodiments of the present disclosure, coupling modes of a drain and a source of each transistor may be interchanged, and thus, the drain and the source of each transistor in the embodiments of the present disclosure are not distinguished. Here, only in order to distinguish two electrodes of the transistor except for a control electrode (i.e., a gate of the transistor), one of the two electrodes is referred to as the drain, and the other of the two electrodes is referred to as the source. The thin film transistor used in the embodiments of the present disclosure may be an N-type transistor or a P-type transistor. In the embodiments of the present disclosure, when the N-type thin film transistor is adopted, a first electrode thereof may be the source, and a second electrode thereof may be the drain. In the following embodiments, the thin film transistors being N-type transistors are taken as an example for illustration.

In the present disclosure, an "active level signal" refers to a signal that can control the transistor to be turned on when it input to the control electrode of the transistor, and an "inactive level signal" refers to a signal that can control the transistor to be turned off when it input to the control electrode of the transistor. For an N-type transistor, a high level signal is an active level signal, and a low level signal is an inactive level signal; for a P-type transistor, a low level signal is an active level signal and a high level signal is an inactive level signal.

In the following description, a case where the transistor is an N-type transistor will be described as an example, and in such case, an active level signal refers to a high level signal and an inactive level signal refers to a low level signal. It is conceivable that when a P-type transistor is employed, the timing of the control signal is to be adjusted accordingly. Specific details are not set forth herein but are to be understood as being within the scope of the disclosure.

Figure 1:
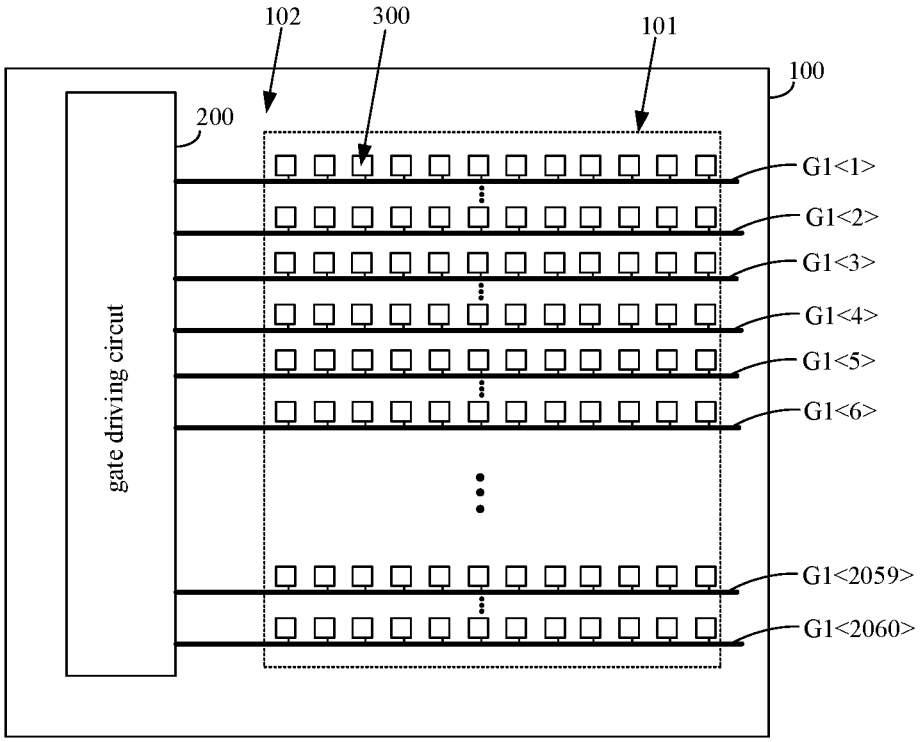
FIG. 1 is a schematic top view of a display device according to an embodiment of the present disclosure.

FIG. 1 is a schematic top view of a display device according to an embodiment of the present disclosure. As shown in FIG. 1, the display device 100 includes: a display area 101 and a peripheral area 102, where a plurality of sub-pixels 300 arranged in an array are provided in the display area 101, each row of sub-pixels 300 is provided with a first gate line G1<*i*> corresponding thereto, and i is an integer; it should be noted that 2160 first gate lines G1<1> to G1<2160> are exemplarily shown in FIG. 1; a gate driving circuit 200 is disposed in the peripheral area 102, and the gate driving circuit 200 includes: a plurality of shift register units (not shown in FIG. 1) which are cascaded, and each shift register unit is connected to a first gate line G1<*i*> corresponding thereto to provide a driving signal to the first gate line G1<*i*> corresponding thereto.

Figure 2:
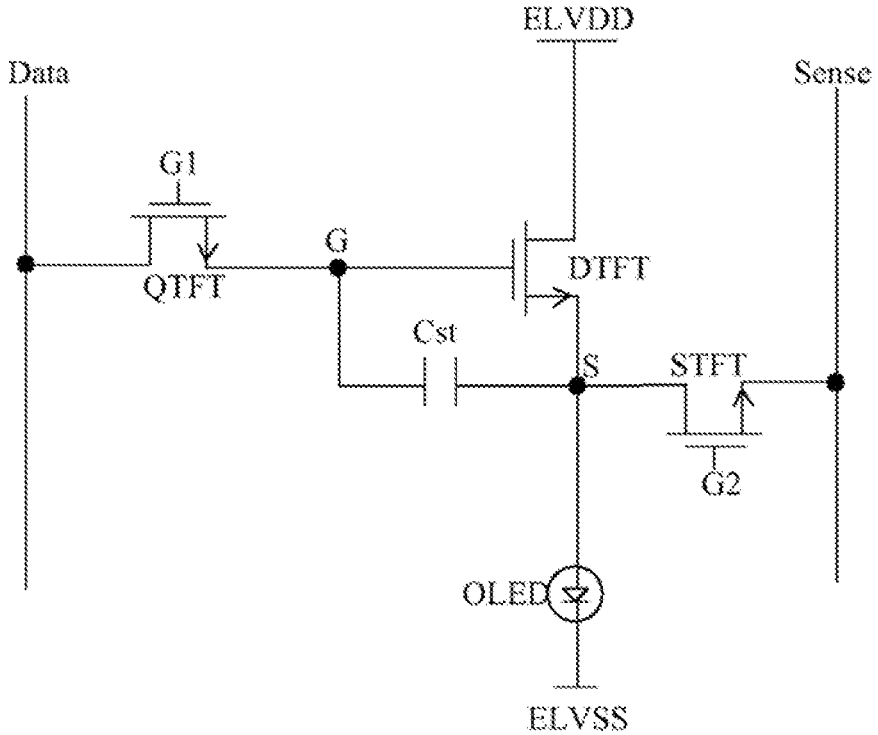
FIG. 2 is a schematic diagram of a circuit structure of a sub-pixel in a display substrate according to the present disclosure.
Figure 3:
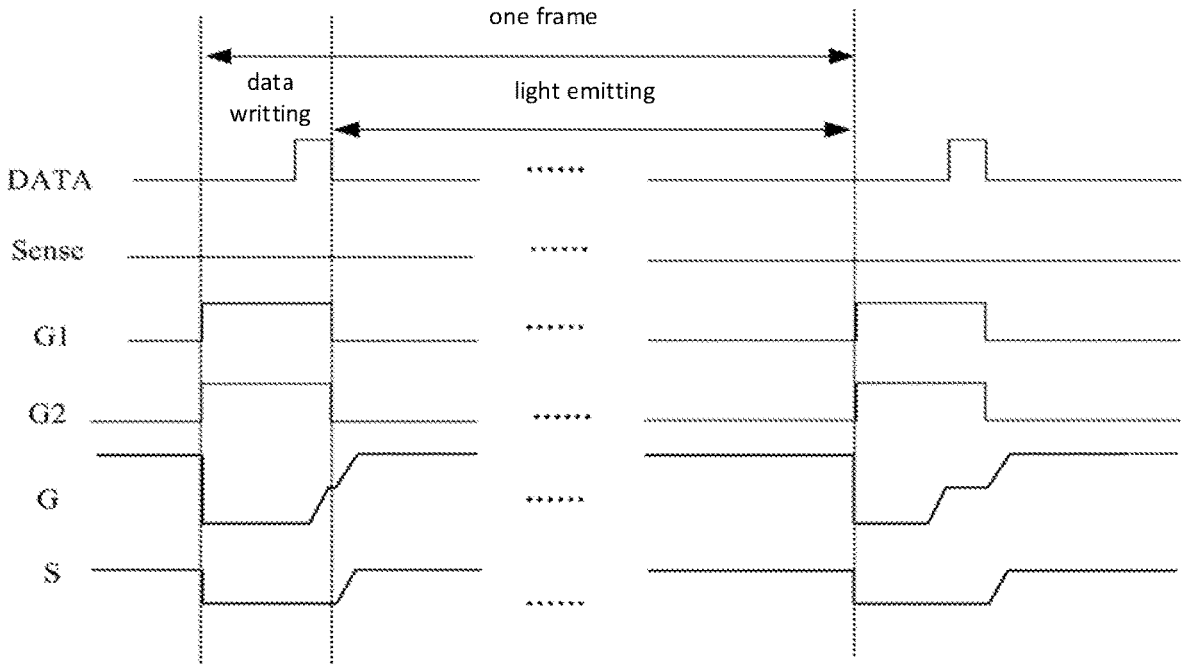
FIG. 3 is an operation timing diagram of the sub-pixel shown in FIG. 2.
Figure 4:
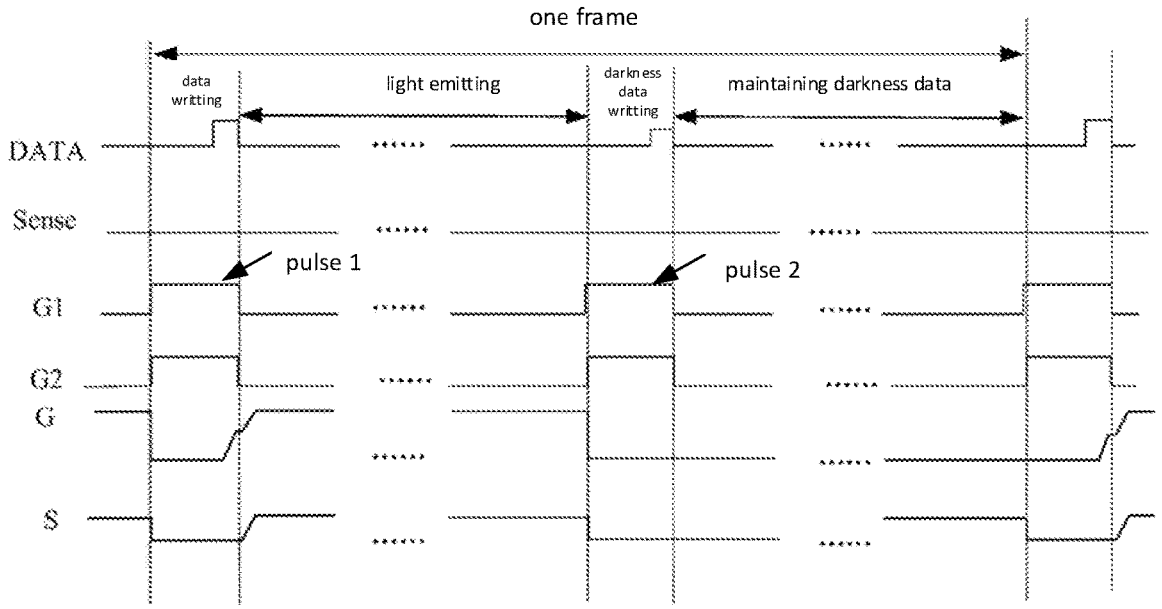
FIG. 4 is another operation timing diagram of the sub-pixel shown in FIG. 2.

FIG. 2 is a schematic diagram of a circuit structure of a sub-pixel in a display substrate according to the present disclosure, FIG. 3 is an operation timing diagram of the sub-pixel shown in FIG. 2, and FIG. 4 is another operation timing diagram of the sub-pixel shown in FIG. 2. As shown in FIGS. 2 to 4, the sub-pixel 300 includes: a pixel circuit and a light emitting element. Hereafter, the light emitting element being an organic light emitting diode (OLED) is taken as an example.

The pixel circuit includes a data writing transistor QTFT (a control electrode thereof is connected to the first gate line G1), a driving transistor DTFT, a sensing transistor STFT (a control electrode thereof is connected to the second gate line G2, and a first electrode thereof is connected to a sensing signal line Sence), and a storage capacitor Cst. Referring to FIGS. 2 and 3, when only the sub-pixel 300 is desired to emit light for displaying, an operation process of the sub-pixel 300 includes a display data writing stage and a light emitting stage; during the display data writing stage, the first gate line G1 controls the data writing transistor QTFT to be turned on, and the data line Data writes a data voltage Vdata into a control electrode of the driving transistor DTFT; in the light emitting stage, the driving transistor DTFT outputs a corresponding driving current according to the voltage at the control electrode thereof, so as to drive the light emitting element OLED to emit light.

It should be noted that, after a frame of image is displayed, the driving transistor DTFT and the light emitting element OLED in the pixel circuit may be subjected to external supplementary sensing by the sensing transistor, and an external compensation is performed on the pixel circuit based on the result of sensing. The specific processes of sensing and compensation are conventional in the art, and are not described herein.

Dynamic image smear may occur during a display process, that is, when the display device switches from one frame of image to another frame of image, the user may feel the smear of the previous frame of image. One solution is as follows: as shown in FIG. 4, a darkness insertion process is performed during the pixel circuit emitting light, which reduces the light emission time duration and enhances the moving picture response time (MPRT), and the larger the MPRT is, the weaker the smear is.

In the related art, the display driving and the darkness insertion driving are integrated in a same gate driving circuit, that is, the shift registers at different stages in the gate driving circuit are used for the display driving and the darkness insertion driving.

An operation process of the gate driving circuit includes display driving stages and darkness insertion driving stages which are alternate, during each display driving stage, signal output terminals of shift registers at certain stages in the gate driving circuit sequentially output display driving signals (for example, pulse 1 in FIG. 3) for display driving, and during each darkness insertion driving stage, signal output terminals of shift registers at certain stages in the gate driving circuit output darkness insertion driving signal (for example, pulse 2 in FIG. 3) for darkness insertion driving. Generally, a plurality of display driving stages are desired for writing display data of a complete frame of image into corresponding pixels.

Figure 5:
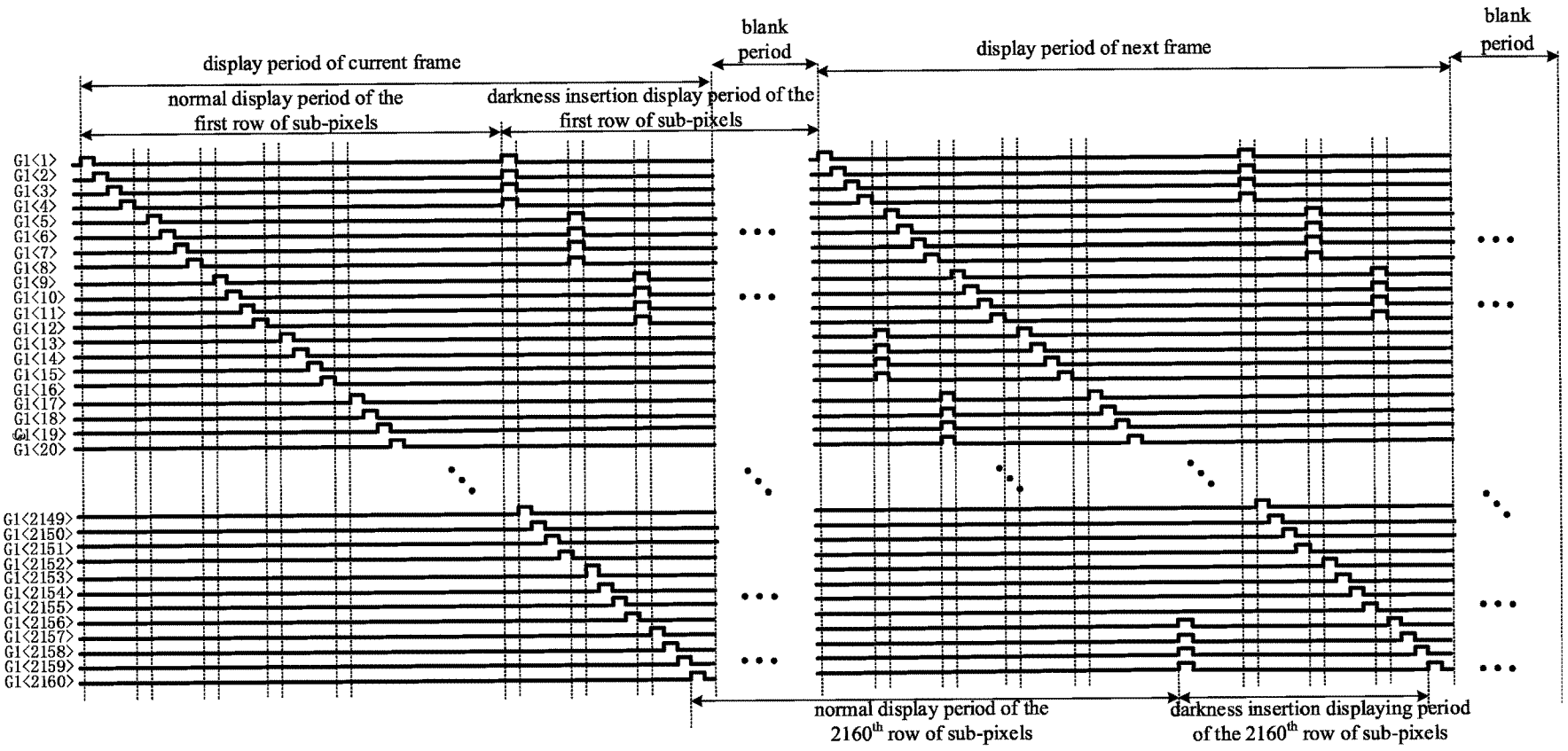
FIG. 5 is an operation timing diagram of a display device in display periods of two consecutive frames of images according to the present disclosure.

FIG. 5 is an operation timing diagram of a display device in display periods of two consecutive frames of images according to the present disclosure. As shown in FIG. 5, the first gate line configured for the $i^{th}$ row of sub-pixels is the first gate line G1<*i*>, and operation timings of 2016 first gate lines G1<1> to G1<2160> are exemplarily shown in the figure.

Since the display driving process and the darkness insertion driving process are not synchronized, a part of rows of sub-pixels may be subjected to the display driving and the darkness insertion driving in the display period of a same frame of image, and the other part of rows of sub-pixels may be subjected to a normal driving in the display period of a current frame of image and may be subjected to the darkness insertion driving in the display period of a next frame of image adjacent to the current frame of image. Taking the case shown in FIG. 5 as an example, the $1^{st}$ to $12^{th}$ rows of sub-pixels are subjected to the normal driving and the darkness insertion driving in the display period of a same frame of image, and the $13^{th}$ to $2160^{th}$ (the last one) rows of sub-pixels are subjected to the normal driving in the display period of the current frame of image thereon and are subjected to the darkness insertion driving in the display period of a next frame of image adjacent to the current frame of image.

Since there is a blank period (in which generally a certain row of sub-pixels may be subjected to external compensation sensing) between the display period of the current frame of image and the display period of the next frame of image adjacent to the current frame of image, normal display time of the $1^{st}$ to $12^{th}$ rows of sub-pixels is different from that of the $13^{th}$ to $2160^{th}$ rows of sub-pixels. Specifically, the normal display time of the $13^{th}$ to $2160^{th}$ rows of sub-pixels is longer than the normal display time of the $1^{st}$ to $12^{th}$ rows of sub-pixels by a first interval period (i.e., one blank period), so that display luminance of the $1^{st}$ to $12^{th}$ rows of sub-pixels is lower than a display luminance of the $13^{th}$ to $2160^{th}$ rows of sub-pixels. The user can perceive a luminance borderline between the $12^{th}$ row of sub-pixels and the $13^{th}$ row of sub-pixels when viewing the display screen, and the luminance borderline between the $12^{th}$ row of sub-pixels and the $13^{th}$ row of sub-pixels will be more visible as the viewing time increases.

In view of the above technical problems in the related art, the present disclosure provides a corresponding solution, which will be described in detail below with reference to specific embodiments.

An embodiment of the present disclosure provides a method for driving a display device, as shown in FIG. 1, n rows of sub-pixels are disposed in a display area 101 of the display device, where n is a positive integer and n>2 (2016 rows of sub-pixels are exemplarily shown in FIG. 1). In the process of displaying each frame of image, the display device is correspondingly configured with a display period and a darkness insertion driving period, where the display period includes: a display driving period and a blank period which are not overlapped with each other, and the darkness insertion driving period includes: a first darkness insertion sub-period and a second darkness insertion sub-period, where, for a same frame of image, the first darkness insertion sub-period is after a starting time of the display driving period and before the blank period, and the second darkness insertion sub-period is after a starting time of the blank period.

Figure 6:
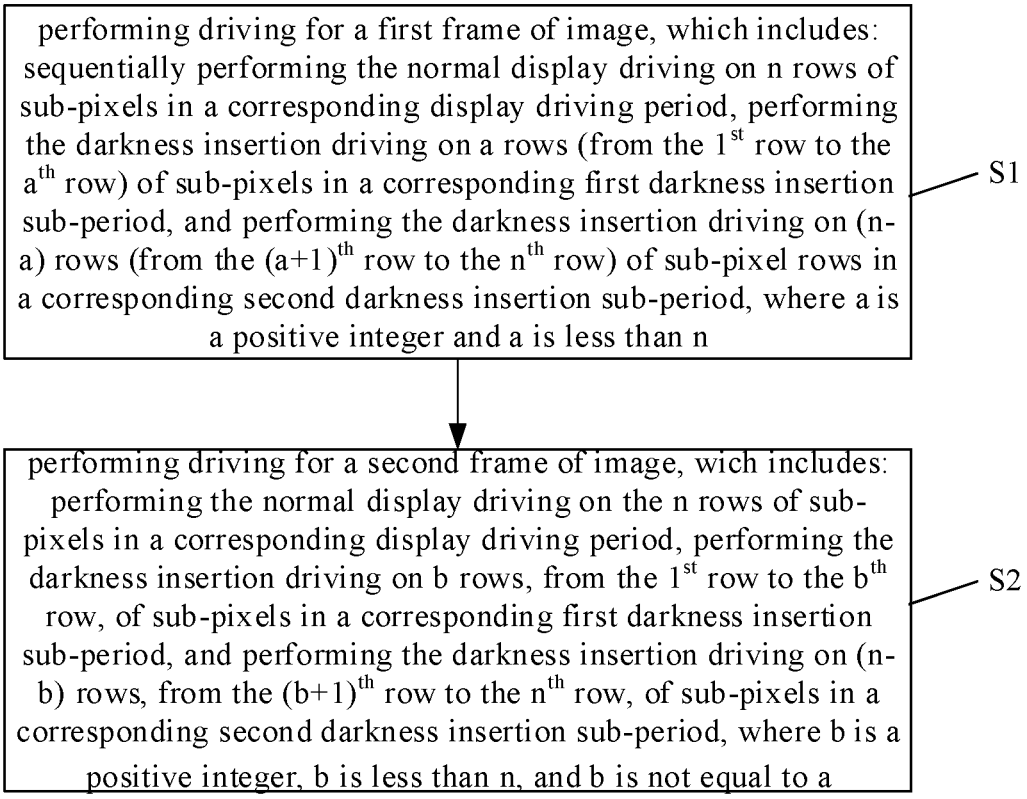
FIG. 6 is a flowchart of a method for driving a display device according to an embodiment of the disclosure.

FIG. 6 is a flowchart of a method for driving a display device according to an embodiment of the disclosure. As shown in FIG. 6, the method for driving the display device includes steps S1 to S2.

At step S1, performing driving for a first frame of image, which includes: sequentially performing normal display driving on n rows of sub-pixels in a corresponding display driving period, performing darkness insertion driving on a rows (from the $1^{st}$ row to the $a^{th}$ row) of sub-pixels in a corresponding first darkness insertion sub-period, and performing darkness insertion driving on (n−a) rows (from the $(a+1)^{th}$ row to the $n^{th}$ row) of sub-pixels in a corresponding second darkness insertion sub-period, where a is a positive integer and a<n.

In a driving process of the first frame of image, normal display driving is sequentially performed on the n rows of sub-pixels in the corresponding display driving period, so that a corresponding data voltage (Vdata) is written into each sub-pixel in the n rows of sub-pixels, and normal display of each sub-pixel is guaranteed.

In a process of darkness insertion driving, the a rows, from the $1^{st}$ row to the $a^{th}$ row, of sub-pixels are subjected to the darkness insertion driving before the starting time of the blank period corresponding to the first frame of image, and the (n−a) rows, from the $(a+1)^{th}$ row to the $n^{th}$ row, of sub-pixels are subjected to the darkness insertion driving after the starting time of the blank period corresponding to the first frame of image, in such case, the normal display time of the (n−a) rows, from the $(a+1)^{th}$ row to the $n^{th}$ row, of sub-pixels is longer than that of the a rows, from the $1^{st}$ row to the $a^{th}$ row, of sub-pixels (by about 1 blank period), so that for the first frame of image, the display luminance of the a rows, from the $1^{st}$ row to the $a^{th}$ row, of sub-pixels is lower than that of the (n−a) rows, from the $(a+1)^{th}$ row to the $n^{th}$ row, of sub-pixels, that is, a luminance borderline exists between the $a^{th}$ row of sub-pixels and the $(a+1)^{th}$ row of sub-pixels.

At step S2, performing driving for a second frame of image, which includes: performing normal display driving on the n rows of sub-pixels in a corresponding display driving period, performing darkness insertion driving on b rows, from $1^{st}$ row to $b^{th}$ row, of sub-pixels in a corresponding first darkness insertion sub-period, and performing darkness insertion driving on (n−b) rows, from $(b+1)^{th}$ row to $n^{th}$ row, of sub-pixels in a corresponding second darkness insertion sub-period, where b is a positive integer, b<n and b≠a.

In a process of darkness insertion driving, the b rows, from the $1^{st}$ row to the $b^{th}$ row, of sub-pixels are subjected to darkness insertion driving before the starting time of the blank period corresponding to the first frame of image, and the (n−b) rows, from the $(b+1)^{th}$ row to the $n^{th}$ row, of sub-pixels are subjected to darkness insertion driving after the starting time of the blank period corresponding to the first frame of image, in such case, the normal display time of the (n−b) rows, from the $(b+1)^{th}$ row to the $n^{th}$ row, of sub-pixels is longer than the normal display time of the b rows, from the $1^{st}$ row to the $b^{th}$ row, of sub-pixels (by about 1 blank period), therefore, for the second frame of image, the display luminance of the b rows, from the $1^{st}$ row to the $b^{th}$ row, of sub-pixels is smaller than that of the (n−b) rows, from the $(b+1)^{th}$ row to the $n^{th}$ row, of sub-pixels, that is, a luminance borderline exists between the $b^{th}$ row of sub-pixels and the $(b+1)^{th}$ row of sub-pixels.

Since a≠b, a position of the luminance borderline in the first frame of image is different from a position of the luminance borderline in the second frame of image, and thus the position of the luminance borderline is varied. Since the time duration corresponding to two frames of images is short and the position of the luminance borderline is not fixed any more, namely the position of the luminance borderline varies in frames, and the position of the luminance borderline varies quickly, the human eyes cannot catch the luminance borderline with the quickly varied position thereof, and the user cannot feel the luminance difference any more, namely the user cannot feel the luminance borderline any more, thereby realizing the purpose of eliminating the luminance borderline.

In some implementations, the first frame of image and the second frame of image are two frames of images adjacent to each other, that is, the position of the luminance borderline varies when the display device displays two consecutive frames of images. In practical applications, the luminance borderline may be designed to randomly vary in position (or randomly varies in a certain position range) within each of a plurality of consecutive frames of images, so as to avoid the luminance borderline from being concentratedly occurred in certain areas within a certain period of time.

FIG. 7*a* is an operation timing diagram of driving the first frame of image in the step S1 according to an embodiment of the present disclosure. As shown in FIG. 7*a*, during performing driving for the first frame of image, normal display driving is performed on the $1^{st}$ to $2160^{st}$ rows of sub-pixels sequentially within a corresponding display driving period T1; during performing darkness insertion driving, the $1^{st}$ to $12^{th}$ rows of sub-pixels are subjected to darkness insertion driving in the first darkness insertion sub-period p1 of a corresponding darkness insertion driving period T2, and the $13^{th}$ to $2160^{th}$ rows of sub-pixels are subjected to darkness insertion driving in a second darkness insertion sub-period p2 of the corresponding darkness insertion driving period T2, in such case, the luminance borderline is between the $12^{th}$ row of sub-pixels and the $13^{th}$ row of sub-pixels.

FIG. 7*b* is an operation timing diagram of driving the second frame of image in the step S2 according to an embodiment of the present disclosure. As shown in FIG. 7*b*, during performing driving for the second frame of image, normal display driving is performed on the $1^{st}$ to $2160^{th}$ rows of sub-pixels sequentially within the corresponding display driving period T1; during performing darkness insertion driving, the $1^{st}$ to $16^{th}$ rows of sub-pixels are subjected to darkness insertion driving in the first darkness insertion sub-period p1 of a corresponding darkness insertion driving period T2, and the $17^{th}$ to $2160^{th}$ rows of sub-pixels are subjected to darkness insertion driving in the second darkness insertion sub-period p2 of the corresponding darkness insertion driving period T2, in such case, the luminance borderline is between the $16^{th}$ row of sub-pixels and the $17^{th}$ row of sub-pixels.

It should be noted that in the case shown in FIG. 7*a* and FIG. 7*b*, n=2160, a=12 and b=16, the first gate line configured for the $i^{th}$ row of sub-pixels is the first gate line G1<*i*>, and the operation timing of 2016 first gate lines G1<1> to G1<2160> are exemplarily shown in the figures, which is only for exemplary purposes and does not limit the technical solution of the present disclosure.

Referring to FIGS. 7*a* and 7*b*, in some implementations, in the display period of a same frame of image, a blank period T3 is after the display driving period T1.

Referring to FIGS. 7*a* and 7*b*, in some implementations, for a same frame of image, the second darkness insertion sub-period p2 is after an ending time of the blank period T3.

Referring to FIGS. 7*a* and 7*b*, in some implementations, during a driving process of the first frame of image, a time interval between a starting time of the normal display driving of the $1^{st}$ row of sub-pixels and a starting time of the darkness insertion driving of the $1^{st}$ row of sub-pixels is j1, and a time interval between the starting time of the normal display driving of the $1^{st}$ row of sub-pixels and a starting time of the blank period T3 is j2; during a driving process of the second frame of image, a time interval between the starting time of the normal display driving of the $1^{st}$ row of sub-pixels and the starting time of the darkness insertion driving of the $1^{st}$ row of sub-pixels is j3, and a time interval between the starting time of the normal display driving of the $1^{st}$ row of sub-pixels and the starting time of the blank period T3 is j4; where j1≠j3 and j2=j4.

FIG. 8*a* is another timing diagram of driving the first frame of image in the step S1 in the present disclosure, and FIG. 8*b* is another timing diagram of driving the second frame of image in the step S2 in the present disclosure. As shown in FIGS. 8*a* and 8*b*, FIGS. 8*a* and 8*b* also exemplarily show operation timings corresponding to driving the first frame of image and the second frame of image when n=2160, a=12, and b=16. Unlike the case shown in FIGS. 7*a* and 7*b*, in the case shown in FIGS. 8*a* and 8*b*, in the display period of a same frame of image, the display driving period T1 includes: a first portion p3 and a second portion p4, part of rows of sub pixels are subjected to normal display driving in the first portion p3, and the other part of rows of sub-pixels are subjected to normal display driving in the second portion p4; the blank period T3 is between the first portion p3 and the second portion p4.

Referring to FIGS. 8*a* and 8*b*, in some implementations, in a driving process of the first frame image, a time interval between a starting time of the normal display driving of the $1^{st}$ row of sub-pixels and a starting time of the darkness insertion driving of the $1^{st}$ row of sub-pixels is j1, and a time interval between the starting time of the normal display driving of the $1^{st}$ row of sub-pixels and a starting time of the blank period T3 is j2; in a driving process of the second frame of image, a time interval between the starting time of the normal display driving of the $1^{st}$ row of sub-pixels and the starting time of the darkness insertion driving of the $1^{st}$ row of sub-pixels is j3, and a time interval between the starting time of the normal display driving of the $1^{st}$ row of sub-pixels and the starting time of the blank period T3 is j4; where j1=j3 and j2≠j4.

It should be noted that when the blank period T3 is between the first portion p3 and the second portion p4 of the display driving period T1, it is also possible for j1≠j3 and j2≠j4, which is not shown in the corresponding figures.

In order to reduce the time for the darkness insertion driving as much as possible, the rows of sub-pixels are generally divided into groups and the darkness insertion driving is performed on the groups one by one. In some implementations, the n rows of sub-pixels are divided into s sub-pixel row groups which are sequentially arranged, each sub-pixel row group includes c rows of sub-pixels, both s and c are positive integers and s*c=n; a=c*s1, b=c*s2, s1 is a positive integer and s1<s, s2 is a positive integer and s2<s, and s1≠s2; in the process of performing the darkness insertion driving on a plurality of rows of sub-pixels in the first darkness insertion sub-period p1 or the second darkness insertion sub-period p2, the darkness insertion driving is performed on the sub-pixel row groups one by one, and the darkness insertion driving is performed on the rows of sub-pixels in the same sub-pixel row group simultaneously in the same period t2.

Taking the cases shown in FIG. 7*a*, FIG. 7*b*, FIG. 8*a* and FIG. 8*b* as an example, four rows of sub-pixels groups are in each sub-pixel row group, the darkness insertion driving is performed on the sub-pixel row groups sequentially, and the darkness insertion driving is performed simultaneously for the rows of sub-pixels in the same sub-pixel row group; accordingly, n=2160, a=12, b=16, c=4, s1=3, and s2=536.

In some implementations, in the first darkness insertion sub-period p1 or the second darkness insertion sub-period p2, a time interval between starting times at which two adjacent sub-pixel row groups start to be subjected to the darkness insertion driving is H, where H=c*h, and h is a duration corresponding to the darkness insertion driving performed on one row of sub-pixels.

In some implementations, there is no overlap between the period t2 in which any one of the sub-pixel row groups is subjected to the darkness insertion driving and the period in which any row of sub-pixels is subjected to the normal display driving.

In the grouping process, the larger the value of c is, the higher the requirement on the timing design of the darkness insertion driving is; the smaller the value of c is, the more the number of the divided sub-pixel row groups is, and the longer the time for the darkness insertion driving is. Based on consideration of the above factors, 2<c<8 is feasible in the present disclosure.

In some implementations, the display driving period includes: s display driving sub-periods t1 corresponding to the sub-pixel row groups one to one, where a time interval exists between any two adjacent display driving sub-periods t1, the time interval is greater than h, and h is the duration corresponding to darkness insertion driving of one row of sub-pixels; the period t2 during which any one of the sub-pixel row groups is subjected to the darkness insertion driving is within the time interval between the two adjacent display driving sub-periods t1 or within the blank period T3.

It should be note that, in the cases shown in FIGS. 7*a*, 7*b*, 8*a*, and 8*b*, the period t2 during which any one of the sub-pixel row groups is subjected to the darkness insertion driving is within the time interval between the adjacent two display driving sub-periods t1.

FIG. 9 is an operation timing diagram of driving a certain frame of image according to an embodiment of the present disclosure. Unlike the cases where the period t2 during which any one of the sub-pixel row groups is subjected to the darkness insertion driving is within the time interval between the adjacent two display driving sub-periods t1 shown in FIGS. 7*a*, 7*b*, 8*a* and 8*b*, in a case shown in FIG. 9, for the period during which the darkness insertion driving is performed on the s sub-pixel row groups corresponding to the frame of image, a period during which the darkness insertion driving is performed on one sub-pixel row group (the first period t2 in the second darkness insertion sub-period p2) is in the blank period T3, and the period t2 during which the darkness insertion driving is performed on each of the other (s−1) sub-pixel row groups is in the time interval between two adjacent display driving sub-periods t1 corresponding thereto. That is, the darkness insertion driving period of a certain sub-pixel row group is set within the blank period T3, and in such case, the periods set outside the blank period T3 for darkness insertion driving of sub-pixel row groups can be reduced by one.

It can be seen from above that, in the embodiment of the present disclosure, the position of the luminance borderline varies in frames, and since the position of the luminance borderline varies rapidly, the human eye cannot capture the luminance borderline with the rapidly varied position thereof, and the user cannot perceive the luminance difference any more, i.e., cannot feel the luminance borderline any more, thereby achieving the purpose of eliminating the luminance borderline.

In the related art, since a source driver IC can output with a limited precision (generally, 15 mv, the source driver IC cannot normally output a voltage less than 15 mv), the voltage expansion cannot be performed for some low gray scales; for example, the gray scale voltage corresponding to gray scale of 32 is generally less than 15 mv, and the gray scale voltages corresponding to other lower gray scales less than 32 are also less than 15 mv, so the source driver IC cannot output the gray scale voltages corresponding to these lower gray scales (e.g. the gray scales less than or equal to 32).

FIG. 10 is a flowchart of a method for driving a display device according to an embodiment of the present disclosure. As shown in FIG. 10, a step S1*a* of determining a light-emission duty ratio of the first frame of image is further included before the step S1, and a step 2*a* of determining a light-emission duty ratio of the second frame of image is further included before the step S2.

FIG. 11 is a flowchart of an alternative implementation of the steps S1*a* and S2*a* of FIG. 10. As shown in FIG. 11, each of the step S1*a* and the step S2*a* may include steps S101 to S103.

At the step S101, obtaining a display gray scale of each of the sub-pixels in a frame of image to be driven, and detecting whether there is any sub-pixel with the display gray scale smaller than a first preset gray scale.

In the process of determining the light-emission duty ratio of the first frame of image, the frame of image to be driven is the first frame of image; and in the process of determining the light-emission duty ratio of the second frame of image, the frame of image to be driven is the second frame of image.

If the sub-pixel with the display gray scale smaller than the first preset gray scale is detected, it indicates that at least one sub-pixel, which displays a low gray scale, exists in the frame of image to be driven, and then the step S102 is performed; if no sub-pixel with the display gray scale smaller than the first preset gray scale is detected, it indicates that no sub-pixel, which displays the low gray scale, exists in the frame of image to be driven, and then the step S103 is performed.

At the step S102, setting the light-emission duty ratio of the frame of image to be driven to be a first preset value Q1.

At the step S103, setting the light-emission duty ratio of the frame of image to be driven to be a second preset value Q2.

The light-emission duty ratio of the frame of image to be driven is t0/T, t0 represents the time interval between the starting time of the normal display driving of the $1^{st}$ row of sub-pixels and the starting time of the darkness insertion driving of the $1^{st}$ row of sub-pixels in the subsequent driving process of the frame of image to be driven, and T represents a total duration of the display period of the frame of image in the subsequent driving process of the frame of image to be driven; where $0<Q1<1$, $0<Q2<1$, and $Q1<Q2$.

For a single sub-pixel, an equivalent luminance (an actual luminance perceived by human eyes) of the sub-pixel in a certain frame of image is equal to a product of a lighting luminance of the sub-pixel (the light-emission luminance of the light-emitting element after the light-emitting element being applied with the gray scale voltage) and the light-emission duty ratio, i.e., the equivalent luminance=the lighting luminance*the light-emission duty ratio. To achieve the sub-pixel exhibiting a certain equivalent luminance, the smaller the light-emission duty ratio is (the shorter the lighting time duration is), the larger the lighting luminance of the sub-pixel is desired, and thus the larger the corresponding gray scale voltage is desired.

Taking a case that the gray scale may be expressed by 10 bits as an example, 1024 gray scales in total from 0 to 1023 may be displayed; where, a maximum display gray scale is 1023, and the equivalent luminance corresponding thereto is L_max; in a case where the light-emission duty ratio is 100%, in order to present the equivalent luminance L_max, the maximum gray scale voltage corresponding to the maximum display gray scale 1023 is Vdata_max1, where Vdata_max1 is relatively low, for example, Vdata_max1=5V (an actual value of Vdata_max1 is to be set according to actual conditions). In such case, the gray scale voltage expansion is performed by using the Vdata_max1 (specific gray scale voltages of the gray scales 0 to 1022 are determined based on the Vdata_max1), with the limitation of the precision of the source driver IC, the gray scale voltages corresponding to low gray scales (for example, the gray scales less than or equal to 32) may not be output by the source driver IC because these gray scale voltages are too low, that is, the low gray scales may not be expanded to.

In a case where the light-emission duty ratio is 50%, in order to present the equivalent luminance L_max, the maximum gray scale voltage corresponding to the maximum display gray scale 1023 may be Vdata_max2, where the Vdata_max2>Vdata_max1, for example, Vdata_max2=10V (an actual value of Vdata_max2 is to be set according to actual conditions), in such case, the gray scale voltage expansion is performed by using the Vdata_max2 (specific gray scale voltages of the gray scales 0 to 1022 are determined based on the Vdata_max2), the gray scale voltages corresponding to the low gray scales are relatively large (certainly larger than the gray scale voltages corresponding to the gray scale voltage expansion by using the Vdata_max1), and thus, at least part of the low gray scale voltages which cannot be output by the source driver IC when the gray scale voltage expansion is performed by using the Vdata_max1 can be output by the source driver IC.

In a case where the light-emission duty ratio is 20%, in order to present the equivalent luminance L_max, the maximum gray scale voltage corresponding to the maximum display gray scale 1023 may be Vdata_max3, where Vdata_max3>Vdata_max2, for example, Vdata_max3=20V (an actual value of Vdata_max3 is to be set according to actual conditions), in such case, the gray scale voltage expansion is performed by using the Vdata_max3 (specific gray scale voltages of the gray scales 0 to 1023 is determined based on the Vdata_max3), the gray scale voltages corresponding to the low gray scales are further increased (certainly greater than the gray scale voltages corresponding to the gray scale voltage expansion performed by using the Vdata_max2), and thus, the gray scale voltage corresponding to each of the gray scales 0 to 1023 can be output by the source driver IC.

Therefore, the smaller the light-emission duty ratio is, the larger the maximum gray scale voltage corresponding to the maximum display gray scale is, and the easier the expansion of the low gray scale voltages in the process of gray scale voltage expansion is to be performed by using the maximum gray scale voltage.

Based on the above principle, in the present disclosure, the light-emission duty ratio of the frame of image to be driven is set based on the display gray scale of each sub-pixel in the frame of image to be driven. Specifically, if at least one sub-pixel in the frame of image to be driven displaying a low gray scale exists, a smaller light-emission duty ratio (i.e., the first preset value Q1) is configured for the frame of image to be driven to ensure that the low gray scale voltages can be expanded (i.e., the source driver IC can output a gray scale voltage corresponding to the low gray scale). If no sub-pixel displaying the low gray scale in the frame of image to be driven exists, a larger light-emission duty ratio (i.e., the first preset value Q2) is configured for the frame of image to be driven, so that the maximum gray scale voltage corresponding to the maximum display gray scale is relatively small, and the gray scale voltage corresponding to each display gray scale is also relatively small, in such case, power consumption and pressure at the electrical elements (such as a TFT, an OLED, and the like) in the sub-pixel can be effectively reduced, which is beneficial to prolonging the service life of the display device.

In the embodiment of the disclosure, for the frame of image to be driven with at least one sub-pixel displaying low gray scale, a smaller light-emission duty ratio is configured, which is beneficial to the expansion of the gray scale voltage corresponding to the low gray scale; meanwhile, for the frame of image to be driven without the sub-pixel displaying the low gray scale, a larger light-emission duty ratio is configured, so that the power consumption of the display device is favorably reduced, and the service life of the display device is prolonged.

In some implementations, the maximum display gray scale that can be displayed by the sub-pixel in the display device is 1023, and the first preset gray scale is 32. Certainly, the maximum display gray scale and the first preset gray scale may also be set to other values, and the specific values thereof may be set as required.

In some implementations, the first preset value Q1=25% and the second preset value Q2=50%. Certainly, the first preset value Q1 and the second preset value Q2 may also be set to other values, and the specific values thereof may be set as required.

FIG. 12 is a flowchart of another alternative implementation of the step S1*a* and the step S2*a* in FIG. 10. As shown in FIG. 12, the flowchart shown in FIG. 12 includes not only the steps S101, S102 and S103 shown in FIG. 11, but also steps S102*a* and S102*b*. The step S102*a* and the step S102*b* will be described in detail below.

After the sub-pixel with the display gray scale smaller than the first preset gray scale is detected in the step S101 and the light-emission duty ratio of the frame of image to be driven is set to the first preset value in the step S102, the following step S102*a* is performed.

At the step S102*a*, detecting whether there is any sub-pixel with the display gray scale larger than the second preset gray scale;

if the sub-pixel with the display gray scale larger than the second preset gray scale is detected, perform the step S102; if no sub-pixel with the display gray scale larger than the second preset gray scale is detected, it indicates that no sub-pixel displaying the high gray scales exists in the frame of image to be driven, and in such case, the frame of image to be driven is dark as a whole, and it can be concluded that, in a very high probability, there are sub-pixels with extremely low display gray scales in the frame of image to be driven, and then the step S102*b* is performed.

At the step S102*b*, setting the light-emission duty ratio of the frame of image to be driven to be a third preset value Q3.

In the step S102*b*, Q3<Q1; since the sub-pixel with the display gray scale smaller than the first preset gray scale exists in the frame of image to be driven, and in a very high probability, there is the sub-pixel with the extremely low display gray scale in the frame of image to be driven, the light-emission duty ratio of the frame of image to be driven may be set smaller (namely Q3 smaller than Q1) so as to ensure that the gray scale voltage can be expanded for the extremely low gray scale.

In some implementations, the maximum display gray scale that can be displayed by the sub-pixel in the display device is 1023, the first preset gray scale is 32, and the second preset gray scale is 255. Certainly, the maximum display gray scale, the first preset gray scale and the second preset gray scale may also be set to other values, and the specific values thereof may be set as required.

In some implementations, the first preset value Q1=25%, the second preset value Q2=50% and the third preset value Q3=10%. Certainly, the first preset value Q1, the second preset value Q2, and the third preset value Q3 may also be set to other values, and specific values thereof may be set as required.

With continued reference to FIGS. 11 and 12, in some implementations, a step S104 and a step S105 are further included after the step S102, the step S103 and the step S102*b*.

At the step S104, determining the maximum gray scale voltage corresponding to the maximum display gray scale which can be displayed by the sub-pixel in the display device in the subsequent driving process of the frame of image to be driven according to the set light-emission duty ratio of the frame of image to be driven.

At the Step S105, performing gray scale voltage expansion according to the maximum gray scale voltage to determine the gray scale voltages corresponding to different display gray scales.

It should be noted that, the specific processes of determining the maximum gray scale voltage according to the light-emission duty ratio and the maximum display gray scale, and performing gray scale expansion according to the maximum gray scale voltage to determine the gray scale voltages corresponding to different display gray scales belong to the conventional technology in the art, and are not described herein again.

Based on the same inventive concept, an embodiment of the disclosure further provides a display driving circuit. FIG. 13 is a schematic top view of a display driving circuit according to an embodiment of the present disclosure, as shown in FIG. 13, the display driving circuit is applied to a display device, and the display device includes: n rows of sub-pixels, n is a positive integer and n>2; each frame of image is configured with a corresponding frame display period and a corresponding darkness insertion driving period, and the frame display period includes: a display driving period and a blank period which are not overlapped with each other, and the darkness insertion driving period includes a first darkness insertion sub-period and a second darkness insertion sub-period, where, for a same frame of image, the first darkness insertion sub-period is after a starting time of the display driving period and before the blank period, and the second darkness insertion sub-period is after a starting time of the blank period.

The display driving circuit includes a gate driving circuit, which is configured to: in the driving process of a first frame of image, sequentially perform normal display driving on rows of sub-pixels in the corresponding display driving period, perform darkness insertion driving on the rows (from $1^{st}$ row to $a^{th}$ row) of sub-pixels in the first darkness insertion sub-period corresponding thereto, and perform the darkness insertion driving on the rows (from $(a+1)^{st}$ row to $(n-a)^{th}$ row) of sub-pixel in the second darkness insertion sub-period corresponding thereto, where a is a positive integer and a is less than n; and in the driving process of the second frame of image, sequentially perform the normal display driving on n rows of sub-pixels in the corresponding display driving period, perform the darkness insertion driving on b rows (from $1^{st}$ row to $b^{th}$ row) of sub-pixels in the corresponding first darkness insertion sub-period, and perform the darkness insertion driving on (n−b) rows (from $(b+1)^{th}$ row to $n^{th}$ row) of sub-pixels in the corresponding second darkness insertion sub-period, where b is a positive integer, $b<n$ and $b\neq a$.

In some implementations, the display driving circuit further includes a central control panel, which is configured to: before the display driving circuit drives each frame of image, obtain a display gray scale of each of the sub-pixels in the frame of image to be driven, and detect whether there is any sub-pixel with the display gray scale smaller than a first preset gray scale; if the sub-pixel with the display gray scale smaller than the first preset gray scale is detected, set a light-emission duty ratio of the frame of image to be driven to be a first preset value Q1; if no sub-pixel with the display gray scale smaller than the first preset gray scale is detected, set the light-emission duty ratio of the frame of image to be driven to be a second preset value Q2; where $Q1<Q2$.

In some implementations, the central control panel is further configured to: after the sub-pixel with the display gray scale smaller than the first preset gray scale is detected and before setting the light-emission duty ratio of the frame of image to be driven to be the first preset value, detect whether there is any the sub-pixel with the display gray scale larger than a second preset gray scale; if the sub-pixel with the display gray scale larger than the second preset gray scale is detected, set the light-emission duty ratio of the frame of image to be driven to be the first preset value; if no sub-pixel with the display gray scale larger than the second preset gray scale is detected, set the light-emission duty ratio of the frame of image to be driven to be a third preset value Q3; where $Q3<Q1$.

Based on the same inventive concept, an embodiment of the present disclosure further provides a display device, which includes the display driving circuit provided in the foregoing embodiment, and for specific description of the display driving circuit, reference may be made to the contents in the foregoing embodiment, and details thereof are not repeated here.

The display device provided by the embodiment of the disclosure may be: any product or component with a display function, such as a flexible wearable device, a mobile phone, a tablet computer, a television, a display, a notebook computer, a digital photo frame, a navigator and the like. It should be understood for those skilled in the art that, other essential components are included in the display device, and are not described herein or should not be construed as limiting the disclosure.

It will be understood that the above embodiments are merely exemplary embodiments adopted to illustrate the principles of the present disclosure, and the present disclosure is not limited thereto. It will be apparent to those skilled in the art that various modifications and improvements may be made without departing from the spirit and scope of the disclosure, and such modifications and improvements are also considered to be within the scope of the disclosure.

The invention claimed is:

1. A method for driving a display device, wherein the display device comprises: n rows of sub-pixels, n being a positive integer and $n>2$;

each frame of image is configured with a corresponding display period and a corresponding darkness insertion driving period, and the display period comprises a display driving period and a blank period which are not overlapped with each other, the darkness insertion driving period comprises a first darkness insertion sub-period and a second darkness insertion sub-period, and for a same frame of image, the first darkness insertion sub-period is after a starting time of the display driving period and before the blank period, the second darkness insertion sub-period is after a starting time of the blank period;

the method comprises:

performing driving for the first frame of image, which comprises: sequentially performing normal display driving on the n rows of sub-pixels in a corresponding display driving period, performing darkness insertion driving on a rows, from the $1^{st}$ row to the $a^{th}$ row, of sub-pixels in a corresponding first darkness insertion sub-period, and performing darkness insertion driving on (n−a) rows, from the $(a+1)^{th}$ row to the $n^{th}$ row, of sub-pixels in a corresponding second darkness insertion sub-period, where a is a positive integer and $a<n$;

performing driving for a second frame of image, which comprises: performing normal display driving on the n rows of sub-pixels in a corresponding display driving period, performing darkness insertion driving on b rows, from the $1^{st}$ row to the $b^{th}$ row, of sub-pixels in a corresponding first darkness insertion sub-period, and performing darkness insertion driving on (n−b) rows, from the $(b+1)^{th}$ row to the $n^{th}$ row, of sub-pixels in a corresponding second darkness insertion sub-period, where b is a positive integer, $b<n$ and $b\neq a$.

2. The method according to claim 1, wherein the first frame of image and the second frame of image are two frames of images adjacent to each other.

3. The method according to claim 1, wherein in the display period of the same frame of image, the display driving period comprises: a first portion and a second portion, wherein part of rows of sub-pixels are subjected to the normal display driving in the first portion, and another part of rows of sub-pixels are subjected to the normal display driving in the second portion; and the blank period is between the first portion and the second portion.

4. The method according to claim 3, wherein, during the driving for the first frame of image, a time interval between a starting time of the normal display driving of the $1^{st}$ row of sub-pixels and a starting time of the darkness insertion driving of the $1^{st}$ row of sub-pixels is j1, and a time interval between the starting time of the normal display driving of the $1^{st}$ row of sub-pixels and a starting time of the blank period is j2;

during the driving for the second frame of image, a time interval between a starting time of the normal display driving of the $1^{st}$ row of sub-pixels and a starting time of the darkness insertion driving of the $1^{st}$ row of sub-pixels is j3, and a time interval between the starting time of the normal display driving of the $1^{st}$ row of sub-pixels and the starting time of the blank period is j4;

wherein j1=j3 and j2≠j4, or during the driving for the first frame of image, a time interval between a starting time of the normal display driving of the $1^{st}$ row of sub-pixels and a starting time of the darkness insertion driving of the $1^{st}$ row of sub-pixels is j1, and a time interval between the starting time of the normal display driving of the $1^{st}$ row of sub-pixels and a starting time of the blank period is j2;

during the driving for the second frame of image, a time interval between a starting time of the normal display driving of the $1^{st}$ row of sub-pixels and a starting time of the darkness insertion driving of the $1^{st}$ row of sub-pixels is j3, and a time interval between the starting time of the normal display driving of the $1^{st}$ row of sub-pixels and the starting time of the blank period is j4;

wherein j1≠j3 and j2≠j4.

5. The method according to claim 1, wherein in the display period of the same frame of image, the blank period is after the display driving period.

6. The method according to claim 5, wherein, for the same frame of image, the second darkness insertion sub-period is after an ending time of the blank period.

7. The method according to claim 5, wherein, during the driving for the first frame of image, a time interval between a starting time of the normal display driving of the $1^{st}$ row of sub-pixels and a starting time of the darkness insertion driving of the $1^{st}$ row of sub-pixels is j1, and a time interval between the starting time of the normal display driving of the $1^{st}$ row of sub-pixels and a starting time of the blank period is j2;

during the driving for the second frame of image, a time interval between the starting time of the normal display driving of the $1^{st}$ row of sub-pixels and the starting time of the darkness insertion driving of the $1^{st}$ row of sub-pixels is j3, and a time interval between the starting time of the normal display driving of the $1^{st}$ row of sub-pixels and the starting time of the blank period T3 is j4;

wherein j1≠j3 and j2=j4.

8. The method according to claim 1, wherein before performing driving for each frame of image, the method further comprises:

obtaining a display gray scale of each sub-pixel in the frame of image to be driven, and detecting whether there is any sub-pixel with the display gray scale smaller than a first preset gray scale;

in response to that the sub-pixel with the display gray scale smaller than the first preset gray scale is detected, setting a light-emission duty ratio of the frame of image to be driven to be a first preset value Q1;

in response to that no sub-pixel with the display gray scale smaller than the first preset gray scale is detected, setting the light-emission duty ratio of the frame of image to be driven to be a second preset value Q2;

the light-emission duty ratio of the frame of image to be driven is t0/T, t0 represents a time interval between a starting time of the normal display driving of the $1^{st}$ row of sub-pixels and a starting time of the darkness insertion driving of the $1^{st}$ row of sub-pixels in a subsequent driving process of the frame of image to be driven, and T represents a total duration of the display period of frame of image in the subsequent driving process of the frame of image to be driven; and 0<Q1<1, 0<Q2<1, and Q1<Q2.

9. The method according to claim 8, further comprising: after setting the light-emission duty ratio of the frame of image to be driven, determining a maximum gray scale voltage corresponding to the maximum display gray scale to be displayed by the sub-pixel in the display device in the subsequent driving process of the frame of image to be driven according to the set light-emission duty ratio of the frame of image to be driven; and performing gray scale voltage expansion according to the maximum gray scale voltage to determine gray scale voltages corresponding to different display gray scales.

10. The method according to claim 8, wherein a maximum display gray scale to be displayed by the sub-pixel in the display device is 1023, and the first preset gray scale is 32, or Q1=25% and Q2=50%, or the method further comprises: after the sub-pixel with the display gray scale smaller than the first preset gray scale is detected and before the light-emission duty ratio of the frame of image to be driven is set to the first preset value, detecting whether there is any sub-pixel with the display gray scale larger than a second preset gray scale;

in response to that the sub-pixel with the display gray scale larger than the second preset gray scale is detected, setting the light-emission duty ratio of the frame to be driven to be the first preset value; and in response to that no sub-pixel with the display gray scale larger than the second preset gray scale is detected, setting the light-emission duty ratio of the frame of image to be driven to be a third preset value Q3, wherein Q3<Q1.

11. The method according to claim 10, wherein the maximum display gray scale to be displayed by the sub-pixel in the display device is 1023, the first preset gray scale is 32, and the second preset gray scale is 255, or Q1=25%, Q2=50%, and Q3=10%.

12. A display driving circuit for implementing the method according to claim 1, the display driving circuit being applied to a display device, the display device comprises: n rows of sub-pixels, n is a positive integer and n>2;

each frame of image is configured with a corresponding display period and a corresponding darkness insertion driving period, and the display period comprises a display driving period and a blank period which are not overlapped with each other, the darkness insertion driving period comprises a first darkness insertion sub-period and a second darkness insertion sub-period, and for a same frame of image, the first darkness insertion sub-period is after a starting time of the display driving period and before the blank period, the second darkness insertion sub-period is after a starting time of the blank period, the display driving circuit comprises a gate driving circuit;

the gate driving circuit is configured to: in a driving process of a first frame of image, sequentially perform normal display driving on rows of sub-pixels in the corresponding display driving period, perform darkness insertion driving on rows, from $1^{st}$ row to $a^{th}$ row, of sub-pixels in the first darkness insertion sub-period corresponding thereto, and perform darkness insertion driving on rows, from $(a+1)^{st}$ row to $(n-a)^{th}$ row, of sub-pixel in the second darkness insertion sub-period corresponding thereto, wherein a is a positive integer and a<n; and in a driving process of the second frame of image, sequentially perform normal display driving on the n rows of sub-pixels in the corresponding display driving period, perform darkness insertion driving on b rows, from $1^{st}$ row to $b^{th}$ row, of sub-pixels in the first darkness insertion sub-period corresponding thereto, and perform darkness insertion driving on (n−b) rows, from $(b+1)^{th}$ row to $n^{th}$ row, of sub-pixels in the second darkness insertion sub-period corresponding thereto, where b is a positive integer, b<n and b≠a.

13. A display device, comprising the display driving circuit according to claim 12.

14. The display driving circuit according to claim 12, wherein the display driving circuit further comprises a central control panel;

the central control panel is configured to: before the display driving circuit drives for each frame of image, obtain a display gray scale of each of the sub-pixels in the frame of image to be driven, and detect whether there is any sub-pixel with the display gray scale smaller than a first preset gray scale; in response to that the sub-pixel with the display gray scale smaller than the first preset gray scale is detected, set a light-emission duty ratio of the frame of image to be driven to be a first preset value Q1; in response to that no sub-pixel with the display gray scale smaller than the first preset gray scale is detected, set the light-emission duty ratio of the frame of image to be driven to be a second preset value Q2, and wherein the light-emission duty ratio of the frame of image to be driven is t0/T, t0 represents a time interval between a starting time of the normal display driving of the $1^{st}$ row of sub-pixels and a starting time of the darkness insertion driving of the $1^{st}$ row of sub-pixels in a subsequent driving process of the frame of image to be driven, and T represents a total duration of the display period of frame of image in the subsequent driving process of the frame of image to be driven; and 0<Q1<1, 0<Q2<1, and Q1<Q2.

15. The display driving circuit according to claim 14, wherein the central control panel is further configured to: after the sub-pixel with the display gray scale smaller than the first preset gray scale is detected and before setting the light-emission duty ratio of the frame of image to be driven to be the first preset value, detect whether there is any sub-pixel with the display gray scale larger than a second preset gray scale; in response to that the sub-pixel with the display gray scale larger than the second preset gray scale is detected, set the light-emission duty ratio of the frame of image to be driven to be the first preset value; in response to that no sub-pixel with the display gray scale larger than the second preset gray scale is detected, set the light-emission duty ratio of the frame of image to be driven to be a third preset value Q3, and wherein

Q3<Q1.

16. The method according to claim 1, wherein the n rows of sub-pixels are divided into s sub-pixel row groups which are sequentially arranged, each sub-pixel row group includes c rows of sub-pixels, both s and c are positive integers and s*c=n; a=c*s1, b=c*s2, s1 is a positive integer and s1<s, s2 is a positive integer and s2<s, and s1≠s2;

in a process of performing the darkness insertion driving on the rows of sub-pixels in the first darkness insertion sub-period or the second darkness insertion sub-period, the darkness insertion driving is performed on the sub-pixel row groups one by one, and the darkness insertion driving is performed on the rows of sub-pixels in a same sub-pixel row group simultaneously.

17. The method according to claim 16, wherein, in the first darkness insertion sub-period or the second darkness insertion sub-period, a time interval between starting times at which two adjacent sub-pixel row groups start to be subjected to the darkness insertion driving is H, H=c*h, h being a duration corresponding to the darkness insertion driving performed on each row of sub-pixels.

18. The method according to claim 16, wherein there is no overlap between a period in which any one of the sub-pixel row groups is subjected to the darkness insertion driving and a period in which any row of sub-pixels is subjected to the normal display driving.

19. The method according to claim 18, wherein the display driving period comprises: s display driving sub-periods which are in correspondence with the sub-pixel row groups one to one, wherein a time interval exists between any two adjacent display driving sub-periods, the time interval is greater than h, and h being a duration corresponding to the darkness insertion driving performed on each row of sub-pixel;

the period during which any one of the sub-pixel row groups is subjected to the darkness insertion driving is within the time interval between two adjacent display driving sub-periods or within the blank period.

20. The method according to claim 19, wherein for the period during which the darkness insertion driving is performed on the s sub-pixel row groups corresponding to each frame of image, a period during which the darkness insertion driving is performed on one sub-pixel row group is located in the blank period, and each period during which the darkness insertion driving is performed on each of other (s−1) sub-pixel row groups is located in the time interval between two adjacent display driving sub-periods corresponding thereto, and wherein 2≤c≤8.

* * * * *